US007334601B1

(12) United States Patent
Torkelson

(10) Patent No.: US 7,334,601 B1
(45) Date of Patent: Feb. 26, 2008

(54) POOL CLEANING SYSTEMS

(76) Inventor: John E. Torkelson, 8825 E. Norwood Cir., Mesa, AZ (US) 85207

( * ) Notice: Subject to any disclaimer, the term of this patent is extended or adjusted under 35 U.S.C. 154(b) by 471 days.

(21) Appl. No.: 11/001,557

(22) Filed: Nov. 30, 2004

Related U.S. Application Data

(60) Provisional application No. 60/528,771, filed on Dec. 12, 2003.

(51) Int. Cl.
*E04H 4/16* (2006.01)
*B65H 75/34* (2006.01)

(52) U.S. Cl. ..... 137/355.2; 15/1.7; 239/197

(58) Field of Classification Search ..... 137/355.2, 137/355.21, 355.22, 355.23, 355.27; 15/1.7; 134/167 R; 239/197, 198; 4/490
See application file for complete search history.

(56) References Cited

U.S. PATENT DOCUMENTS 3,289,216 A * 12/1966 Anthony et al. ..... 4/490
3,392,738 A * 7/1968 Pansini ..... 134/167 R
4,228,553 A 10/1980 Genuit
4,776,953 A * 10/1988 Frentzel ..... 210/167.15
4,793,376 A * 12/1988 Hare ..... 137/355.23
4,929,155 A * 5/1990 Finley ..... 417/53
D318,787 S 8/1991 Mitchell
5,626,307 A 5/1997 Smith
6,327,741 B1 12/2001 Reed
6,386,473 B1 5/2002 Vitaletti
6,895,984 B1 * 5/2005 Pansini ..... 137/1
6,922,855 B1 * 8/2005 Swalley et al. ..... 4/490
6,971,124 B2 * 12/2005 Pansini ..... 4/490
6,974,103 B1 * 12/2005 Pansini ..... 242/390.5
7,096,876 B2 * 8/2006 Pansini ..... 137/1
2004/0021030 A1 2/2004 Brocking

* cited by examiner

*Primary Examiner*—John Fox
(74) *Attorney, Agent, or Firm*—Stoneman Volk Patent Group; Martin L. Stoneman; Michael D. Volk, Jr.

(57) ABSTRACT

A vacuum pool cleaning system that is housed in the side of the swimming pool. The pool vacuum unreels itself and vacuums the pool when the central pool vacuum pump is turned on, and reels itself back into storage when the central pool vacuum pump is turned off. The vacuum hose is stored on a reel below the water line. The system is powered entirely by the vacuum from the pool vacuum pump.

33 Claims, 13 Drawing Sheets

POOL CLEANING SYSTEMS

CROSS-REFERENCE TO RELATED APPLICATION

The present application is related to and claims priority from prior provisional application Ser. No. 60/528,771 filed Dec. 12, 2003, entitled "SWIMMING POOL VACUUM AND HOSE AUTOMATIC DEPLOYMENT AND RETRIEVAL GARAGE", the content of which is incorporated herein by this reference and is not admitted to be prior art with respect to the present invention by the mention in this cross-reference section.

BACKGROUND

This invention relates to providing pool cleaning systems.

More particularly, this invention relates to providing a system for improved storage and deployment of pool vacuuming components.

Typically, a random-motion pool vacuum is coupled to a hose which is coupled to the central pool vacuum pump. The pool vacuum pump and hose are placed in the pool and primed for use, and must be removed from the pool and drained of water so that the pool can be used for swimming. This is very labor-intensive and time-consuming.

Therefore, a need exists for a system that can deploy a pool vacuum and hose automatically, and retract the pool vacuum and hose automatically. Further, a need exists for a vacuum system that remains continuously primed.

OBJECTS AND FEATURES OF THE INVENTION

A primary object and feature of the present invention is to provide pool cleaning systems. A further primary object and feature of the present invention is to provide a pool cleaning system that automatically deploys a pool vacuum, and automatically retracts the pool vacuum.

It is a further object and feature of the present invention to provide such a system that can be run entirely on the suction power provided by a pool vacuum pump. It is yet another object and feature of the present invention to provide such a system that is stored underwater, to maintain a primed state.

It is yet another object and feature of the present invention to provide such a system having an underwater hose reel.

It is a further object and feature of the present invention to provide such a system including methods of cleaning pools.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a cleaning system, relating to automatic vacuum means relating to cleaning at least one pool of water, comprising: vacuum hose means for providing at least one vacuum hose having at least one first end and at least one second end; hose reel means for reeling such vacuum hose means; hose deployer means for deploying such at least one first end of such vacuum hose means into the at least one pool of water; and hose retractor means for retracting such vacuum hose means onto such hose reel means; wherein such vacuum hose means is adapted to remain continuously full of water when retracted onto such hose reel means.

In accordance with another preferred embodiment hereof, this invention provides a cleaning system, relating to at least one automatic vacuum relating to cleaning at least one pool of water having at least one waterline, comprising: at least one vacuum hose having at least one first end and at least one second end; at least one vacuum pump, wherein such at least one vacuum pump is attached to such at least one second end of such at least one vacuum hose; at least one hose reel adapted to reel such at least one vacuum hose; at least one hose deployer adapted to deploy such at least one first end of such at least one vacuum hose into such at least one pool of water; and at least one hose retractor adapted to retract such at least one vacuum hose onto such at least one hose reel; wherein such at least one vacuum hose is adapted to remain continuously full of water when retracted onto such at least one hose reel.

Moreover, it provides such a cleaning system, wherein such at least one hose deployer comprises at least one hydraulic actuator. Additionally, it provides such a cleaning system, further comprising at least one housing adapted to house such at least one vacuum hose, on such at least one hose reel, below such at least one waterline of such at least one pool of water. Also, it provides such a cleaning system, wherein such at least one housing further comprises at least one door adapted to provide at least one exit from such at least one housing into such at least one pool of water. In addition, it provides such a cleaning system, wherein such at least one door is below such at least one waterline of such at least one pool of water. And, it provides such a cleaning system, wherein such at least one vacuum hose is entirely within such at least one housing when such at least one vacuum hose is retracted for storage.

Further, it provides such a cleaning system, wherein such at least one vacuum hose further comprises at least one vacuum cleaner, wherein such at least one vacuum cleaner is attached to such at least one first end of such at least one vacuum hose.

Even further, it provides such a cleaning system, wherein such at least one hose deployer comprises at least one automatic hose deployer adapted to automatically deploy such at least one vacuum hose when such at least one vacuum pump is turned on. Moreover, it provides such a cleaning system, wherein such at least one hose retractor comprises at least one automatic hose retractor adapted to automatically retract such at least one vacuum hose when such at least one vacuum pump is turned off.

Additionally, it provides such a cleaning system, wherein such at least one hose deployer is powered by such at least one vacuum pump. Also, it provides such a cleaning system, further comprising at least one automatic switch adapted to automatically switch such at least one vacuum pump from powering such at least one hose deployer to pulling water through such at least one vacuum hose after such at least one hose deployer deploys such at least one vacuum hose. In addition, it provides such a cleaning system, further comprising at least one hydraulic motor adapted to power at least one motor with water moved by such at least one vacuum pump. And, it provides such a cleaning system, wherein such at least one hose deployer is powered by such at least one hydraulic motor.

Further, it provides such a cleaning system, wherein such at least one hose retractor comprises at least one spring adapted to wind such at least one hose reel. Even further, it provides such a cleaning system, wherein such at least one hose deployer comprises at least one articulated carrier adapted to carry such at least one hose deployer from at least one retracted position to at least one deployed position and vice versa.

Moreover, it provides such a cleaning system, wherein such at least one vacuum pump powers such at least one articulated carrier. Additionally, it provides such a cleaning system, wherein such at least one vacuum pump simultaneously powers such at least one articulated carrier and such at least one hose deployer. Also, it provides such a cleaning system, further comprising at least one retraction detector adapted to detect the complete retraction of such at least one vacuum hose onto such at least one reel. In addition, it provides such a cleaning system, wherein such at least one articulated carrier is adapted to carry such at least one hose deployer from at least one deployed position to at least one retracted position when such at least one retraction detector detects the complete retraction of such at least one vacuum hose onto such at least one reel.

And, it provides such a cleaning system, further comprising at least one deployment detector adapted to detect the finished deployment of such at least one vacuum hose off of such at least one reel. Further, it provides such a cleaning system, wherein such at least one hose deployer is powered by such at least one vacuum pump prior to such at least one deployment detector detecting the finished deployment of such at least one vacuum hose off of such at least one reel. Even further, it provides such a cleaning system, wherein such at least one vacuum pump pulls water through such at least one vacuum hose after such at least one deployment detector detects the finished deployment of such at least one vacuum hose off of such at least one reel.

Moreover, it provides such a cleaning system, further comprising at least one automatic switch adapted to automatically switch such at least one vacuum pump from powering such at least one hose deployer to pulling water through such at least one vacuum hose after such at least one deployment detector detects the finished deployment of such at least one vacuum hose off of such at least one reel. Additionally, it provides such a cleaning system, wherein such at least one automatic switch comprises at least one hydraulic actuator.

Also, it provides such a cleaning system, wherein such at least one deployment detector comprises: at least one spring-loaded lever adapted to provide at least one spring-loaded lever on the interior of such at least one hose reel wherein such at least one spring-loaded lever is compressed when such at least one vacuum hose presses such at least one spring-loaded lever; and wherein such at least one spring-loaded lever is released when such at least one vacuum hose is removed from such at least one spring-loaded lever; at least one spring-loaded bar adapted to provide at least one spring-loaded bar on the exterior of such at least one hose reel wherein such at least one spring-loaded bar is pulled into at least one retracted position when such at least one spring-loaded lever is compressed; and wherein such at least one spring-loaded bar means is released into at least one extended position when such at least one spring-loaded lever is released; at least one spring-loaded switch wherein such at least one spring-loaded switch is open when such at least one spring-loaded bar is pulled into such at least one retracted position; and wherein such at least one spring-loaded switch is closed when such at least one spring-loaded bar is released into such at least one extended position and contacts such at least one spring-loaded switch.

In addition, it provides such a cleaning system, further comprising at least one automatic switch adapted to automatically switch such at least one vacuum pump from powering such at least one hose deployer to pulling water through such at least one vacuum hose after such at least one spring-loaded switch is closed.

And, it provides such a cleaning system, wherein such at least one hose deployer comprises: at least one hydraulic motor; wherein such at least one hydraulic motor is powered by such at least one vacuum pump; at least one hose-guiding wheel adapted to guide such at least one vacuum hose; at least one hose-moving wheel adapted to move such at least one vacuum hose; at least one wheel compressor adapted to compress such at least one vacuum hose between such at least one hose-guiding wheel and such at least one hose-moving wheel; wherein such at least one wheel compressor is actuated by such at least one vacuum pump; and at least one drive adapted to drive such at least one hose-moving wheel off of such at least one hydraulic motor; whereby, when such at least one vacuum pump is turned on, such at least one vacuum hose is laterally compressed and is rolled longitudinally between such at least one hose-guiding wheel and such at least one hose-moving wheel.

Further, it provides such a cleaning system, wherein such at least one drive comprises at least one drive chain. Even further, it provides such a cleaning system, further comprising at least one drive tensioner adapted to provide consistent tension to such at least one drive chain. Even further, it provides such a cleaning system, wherein such at least one hose-guiding wheel comprises such at least one hose-moving wheel.

In accordance with another preferred embodiment hereof, this invention provides a system, comprising: at least one vacuum pump; at least one hydraulic motor; wherein such at least one hydraulic motor is powered by such at least one vacuum pump; at least one hose-guiding wheel adapted to guide at least one hose; at least one hose-moving wheel adapted to move such at least one hose; at least one wheel tensioner adapted to tension such at least one hose between such at least one hose-guiding wheel and such at least one hose-moving wheel; wherein such at least one wheel tensioner is tensioned by such at least one vacuum pump; and at least one drive adapted to drive such at least one hose-moving wheel off of such at least one hydraulic motor; whereby, when such at least one vacuum pump is turned on, such at least one hose is laterally compressed and is rolled longitudinally between such at least one hose-guiding wheel and such at least one hose-moving wheel.

In accordance with another preferred embodiment hereof, this invention provides a cleaning system, comprising the steps of: storing at least one hose reel in at least one body of water; reeling at least one hose onto such at least one hose reel in such at least one body of water; storing such at least one hose reel having such at least one hose in such at least one body of water; and unreeling such at least one hose off of such at least one hose reel in such at least one body of water; whereby such at least one hose is kept constantly filled with water.

Even further, it provides such a cleaning system, wherein the step of unreeling such at least one hose off of such at least one hose reel in such at least one body of water further comprises the step of using at least one hydraulic motor to unreel such at least one hose off of such at least one hose reel in such at least one body of water. Even further, it provides such a cleaning system, wherein the step of using at least one hydraulic motor to unreel such at least one hose off of such at least one hose reel in such at least one body of water further comprises the step of using at least one vacuum pump to pull water through such at least one hydraulic motor.

Even further, it provides such a cleaning system, further comprising the step of automatically switching such at least one vacuum pump from pulling water through such at least one hydraulic motor to pulling water through such at least one vacuum hose after such at least one vacuum hose is unreeled from such at least one reel. Even further, it provides such a cleaning system, wherein such step of automatically switching further comprises the step of actuating at least one hydraulic actuator.

Even further, it provides such a cleaning system, wherein such step of reeling such at least one hose on to such at least one hose reel in such at least one body of water further comprises the step of using at least one spring to reel such at least one hose on to such at least one hose reel in such at least one body of water. Even further, it provides such a cleaning system, further comprising the step of pulling at least one flow of water through such at least one hose.

In accordance with another preferred embodiment hereof, this invention provides a pool cleaning system, comprising: at least one vacuum hose; at least one hose deployer adapted to deploy such at least one vacuum hose from at least one retracted position; and at least one hose retractor adapted to retract such at least one vacuum hose from at least one deployed position; wherein such at least one hose deployer comprises at least one hydraulic actuator.

DETAILED DESCRIPTION OF THE BEST MODES AND PREFERRED EMBODIMENTS OF THE INVENTION

Figure 1:
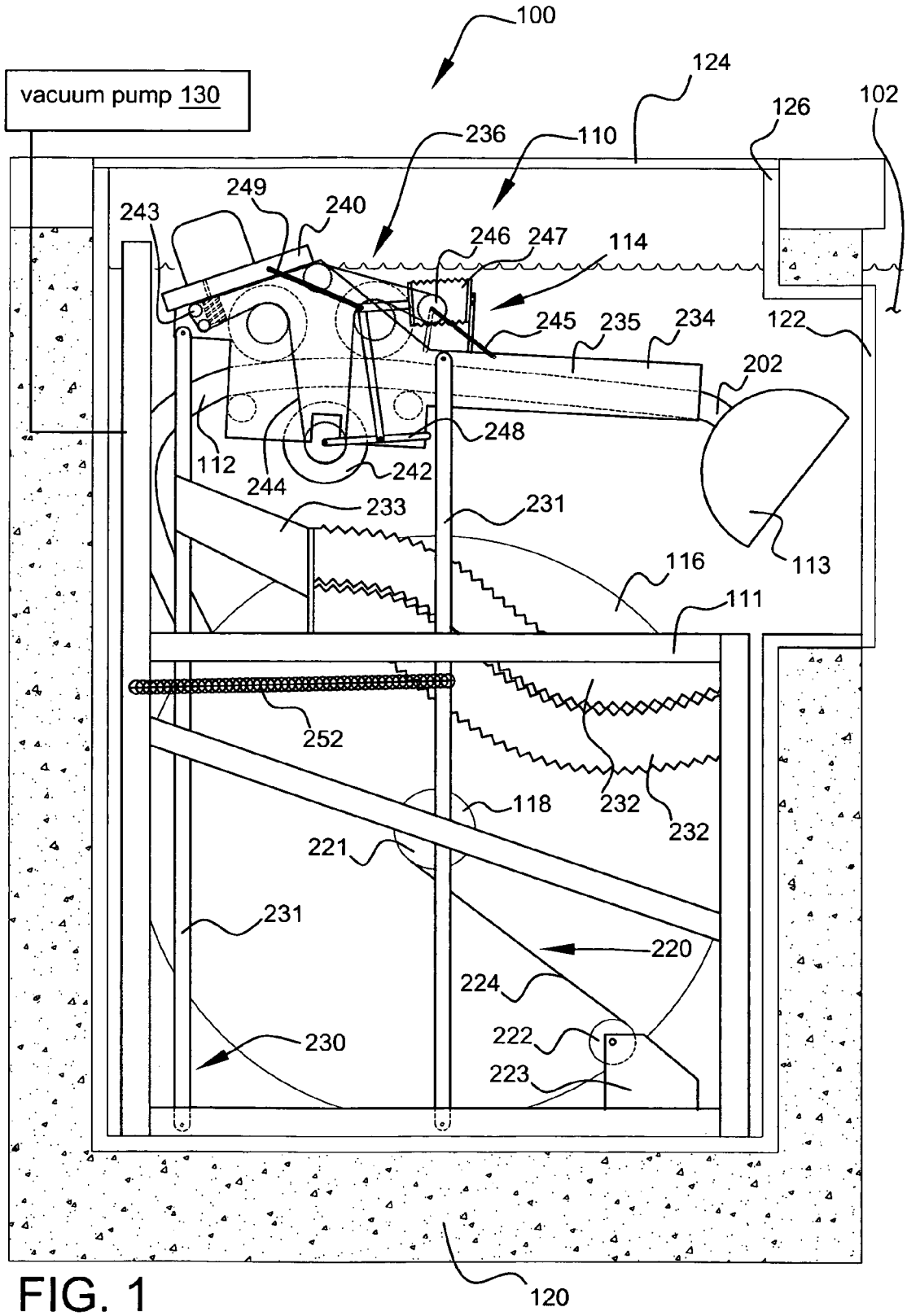
FIG. 1 shows a side plan view of a pool cleaning system, retracted into its pool-wall housing, according to a preferred embodiment of the present invention.

FIG. 1 shows a side plan view of a pool cleaning system 100, retracted into its pool-wall housing 120, according to a preferred embodiment of the present invention. Preferably, pool cleaning system 100 comprises automatic vacuum assembly 110, housing 120, and vacuum pump 130, as shown. Preferably, automatic vacuum assembly 110 is housed within housing 120, and is connected to vacuum pump 130, as shown. Preferably, automatic vacuum assembly 110 is stored in housing 120 when vacuum pump 130 is off, as shown, and automatic vacuum assembly 110 automatically deploys vacuum hose 112 into pool 102 through door 122 when vacuum pump 130 is on, as shown. Automatic vacuum assembly 110 is shown in FIG. 1 in a retracted, stored state, where automatic vacuum assembly 110 is entirely within housing 120. Upon reading the teachings of this specification, those with ordinary skill in the art will now understand that, under appropriate circumstances, considering such issues as advances in technology, user preference, etc., other automatic vacuum assembly components, such as timers, sensors, remote controls, chemical addition systems, etc., may suffice.

Preferably, housing 120 is built into the side of a pool, preferably under a portion of the pool deck, which communicates with the water in the pool, so that automatic vacuum assembly 110 may be placed into housing 120 and be substantially submerged below the waterline of the pool, as shown (at least embodying herein the step of storing at least one hose reel in at least one body of water). Preferably, housing 120 is about one foot wide by about two feet deep (excluding the tunnel to door 122) by about four feet tall. Preferably automatic vacuum assembly 110 is submerged within housing 120 and automatic vacuum assembly 110 is kept constantly full of water, which is necessary for most vacuum pumps 130. This eliminates the typical step of priming a vacuum hose 112 prior to use. Preferably, automatic vacuum assembly 110 is kept conveniently close to the pool, and retracts out of sight when not in use. Upon reading the teachings of this specification, those with ordinary skill in the art will now understand that, under appropriate circumstances, considering such issues as advances in technology, user preference, etc., other arrangements, such as placing the housing underneath the pool, having a dry housing, and keeping the hoses filled with water by other means, other housing dimensions, etc., may suffice.

Preferably, housing 120 communicates to the pool through door 122, as shown. Preferably, door 122 is entirely below the waterline of the pool, as shown. Preferably, door 122 is hinged on one side, and is opened and closed by the deployment and retraction of automatic vacuum assembly 110. Preferably, door 122 is held open, preferably open about 180 degrees against the adjacent pool wall, when automatic vacuum assembly 110 is in a deployed state. Preferably, door 122 is held closed when automatic vacuum assembly 110 is in a retracted state. Preferably, door 122 is about fourteen inches wide by about fourteen inches tall. Upon reading the teachings of this specification, those with ordinary skill in the art will now understand that, under appropriate circumstances, considering such issues as advances in technology, user preference, etc., other arrangements, such as bifold doors, sliding doors, no door, a door partially above the waterline, a door large enough to insert and remove the automatic vacuum assembly, etc., may suffice.

Preferably, housing 122 communicates to the pool deck surface through surface hatch 124, as shown. Preferably, surface hatch 124 is large enough to permit access to automatic vacuum assembly 110 for cleaning and repairs, as shown. More preferably, surface hatch 124 is large enough to permit automatic vacuum assembly 110 to be conveniently inserted into and removed from housing 120, as shown. Upon reading the teachings of this specification, those with ordinary skill in the art will now understand that, under appropriate circumstances, considering such issues as advances in technology, user preference, etc., other arrangements, such as no surface hatch, etc., may suffice.

Preferably, housing 120 is constructed while the pool is being constructed, by digging a sufficiently-sized hole, inserting concrete form 126 positioned to connect with the interior of the pool, and then filling the remainder of the hole with concrete (preferably shotcrete). Upon reading the teachings of this specification, those with ordinary skill in the art will now understand that, under appropriate circumstances, considering such issues as advances in technology, user preference, etc., other arrangements, such as retrofitting an existing pool, using other structural materials, not using a form, etc., may suffice.

Preferably, vacuum pump 130 is a central vacuum pump of the sort commonly known in the art of swimming pools. Preferably, vacuum pump 130 connects to hydraulic system 150 of automatic vacuum assembly 110, further described below.

Preferably, automatic vacuum assembly 110 comprises vacuum hose 112, deployer 114, reel 116, and retractor 118, as shown. Preferably, automatic vacuum assembly 110 also comprises chassis 111 and vacuum cleaner 113, as shown. Upon reading the teachings of this specification, those with ordinary skill in the art will now understand that, under appropriate circumstances, considering such issues as advances in technology, user preference, etc., other components, such as timers, sensors, chemical adding equipment, etc., may suffice.

Figure 9:
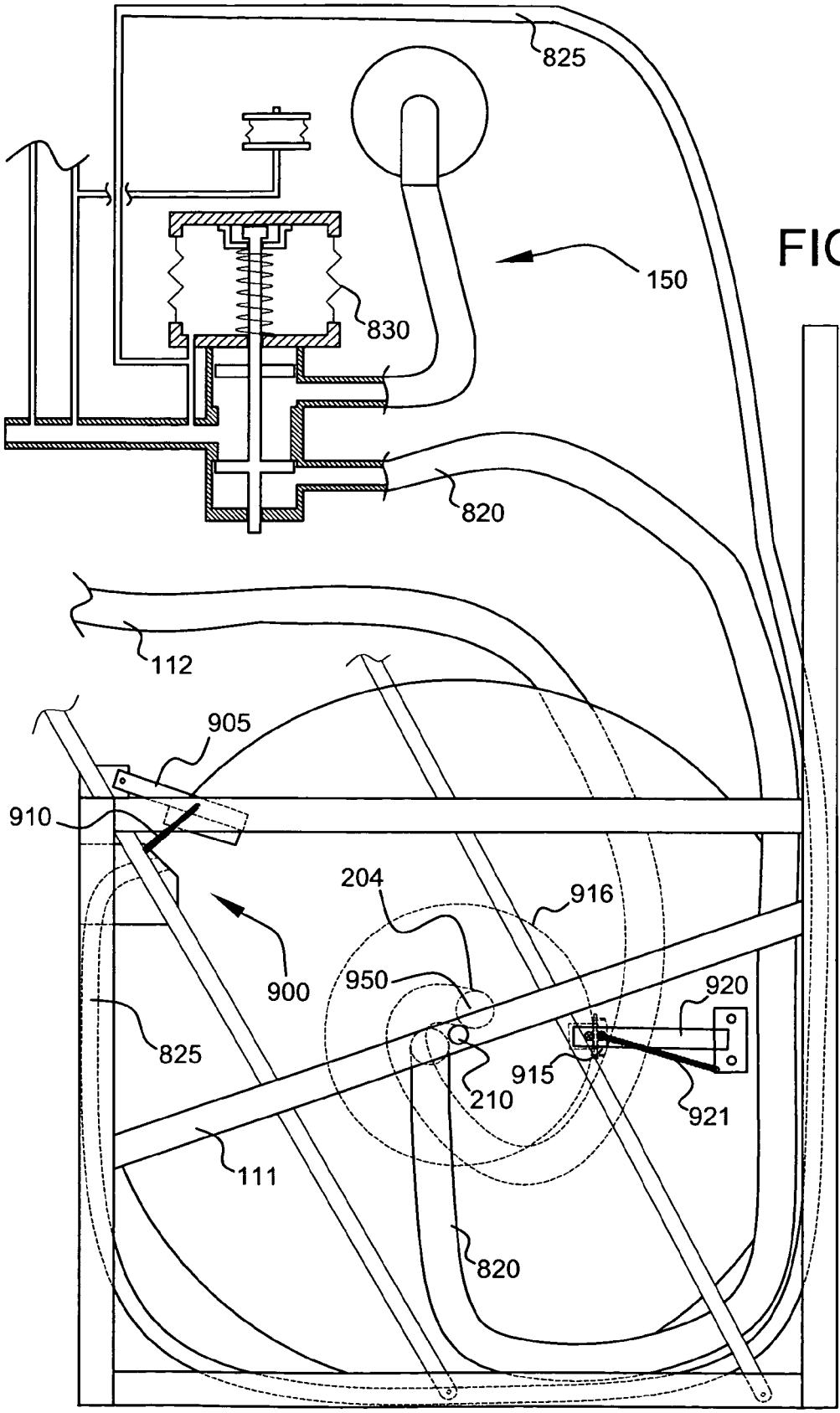
FIG. 9 shows a diagram of the state of the hydraulic system during vacuum hose deployment, with the hose deployment sensor lever depressed.

Preferably, vacuum hose 112 comprises a reinforced, two-inch diameter swimming pool vacuum hose of the sort known in the art of swimming pool maintenance, as shown, such as those manufactured by Hayward Pool Products, Inc., of Elizabeth, N.J., US. Preferably, vacuum hose 112 has a laterally-ridged exterior surface. Preferably, vacuum hose 112 has a first end 202, preferably connected to vacuum cleaner 113, as shown, and a second end 204, which is preferably secured inside reel 116 and which preferably detachably connects to hydraulic system 150 (as shown in FIG. 9). Preferably, vacuum hose 112 is wound onto reel 116 for storage, as shown (at least embodying herein the step of reeling at least one hose onto such at least one hose reel in such at least one body of water; and at least embodying herein the step of storing such at least one hose reel having such at least one hose in such at least one body of water). Upon reading the teachings of this specification, those with ordinary skill in the art will now understand that, under appropriate circumstances, considering such issues as advances in technology, user preference, etc., other arrangements, such as a stopper on the end of the vacuum hose to prevent the vacuum hose from retracting into the deployer when the vacuum cleaner is removed, other vacuum hose types, other vacuum hose diameters, etc., may suffice.

Figure 13:
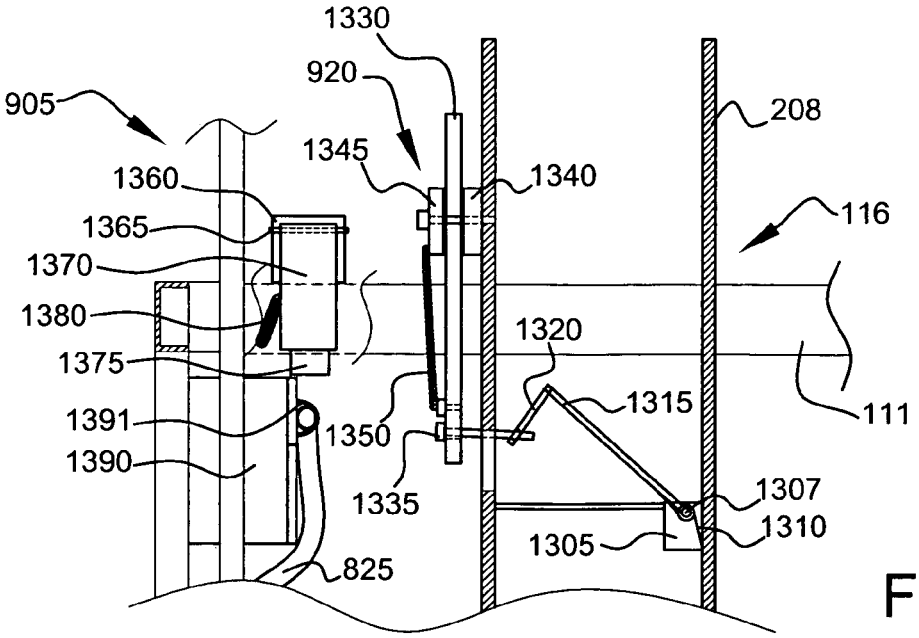
FIG. 13 shows an enlarged portion of FIG. 12, with the reel moved aside to clearly show the workings of the hose deployment sensor.

Preferably, reel 116 comprises hub 206, sides 208, and axle 210 (shown in cross-section in FIG. 13). Preferably, axle 210 connects to chassis 111, as shown. Preferably, hub 206 is two hose-widths wide, as shown in FIG. 13, and sides 208 are tall enough to hold about seven lengths of standard four-foot long vacuum hoses 112 (about 28 feet of two-inch diameter vacuum hose 112). Upon reading the teachings of this specification, those with ordinary skill in the art will now understand that, under appropriate circumstances, considering such issues as advances in technology, user preference, pool size, etc., other arrangements, such as the reel being wide enough to hold three hose-widths, sized to hold ten hose-lengths, holding a length of hose suited for a particular pool, a single-piece hose of the required length, etc., may suffice.

Preferably, chassis 111 supports the other components of automatic vacuum assembly 110, as shown. Preferably, chassis 111 comprises aluminum bar stock, as shown.

Preferably, automatic vacuum assembly 110 is constructed of materials able to withstand prolonged submersion in pool water, such as, for example, ozonated water, chlorinated water, or salt water. Preferred materials include aluminum, stainless steel, oxidation-resistant plastics such as, for example, Teflon and PVC, etc. Where multiple types of metals are used, care should be taken to prevent galvanic corrosion reactions. Upon reading the teachings of this specification, those with ordinary skill in the art will now understand that, under appropriate circumstances, considering such issues as advances in technology, user preference, etc., other materials, such as other metals, other plastics, composite materials, coated materials, etc., may suffice.

Preferably, retractor 118 retracts vacuum hose 112 when vacuum hose 112 is released from deployer 114 and is allowed to move freely. Preferably, retractor 118 rotates reel 116 counterclockwise to wind vacuum hose 112 onto reel 116, as shown. Preferably, retractor 118 comprises spring 220, as shown, which is wound when vacuum hose 112 is deployed from reel 116 (at least embodying herein wherein such step of reeling such at least one hose on to such at least one hose reel in such at least one body of water further comprises the step of using at least one spring to reel such at least one hose on to such at least one hose reel in such at least one body of water). Preferably, spring 220 comprises a constant-force spring, as shown. Preferably, spring 220 comprises spring hub 221, which is preferably attached to axle 210, drum 222, which is preferably attached to chassis 111 by bracket 223, and spring band 224, as shown. Upon reading the teachings of this specification, those with ordinary skill in the art will now understand that, under appropriate circumstances, considering such issues as advances in technology, user preference, etc., other retractors, such as other types of springs, motorized retractors, etc., may suffice.

Preferably, deployer 114 comprises carriage 230, deployment bellows 232, housing 234, and drive system 236, as shown. Preferably, deployer 114 moves to deploy the first end 202 of vacuum hose 112 into the pool during vacuuming (at least embodying herein the step of unreeling such at least one hose off of such at least one hose reel in such at least one body of water), and retracts into housing 120 for storage, as shown. Upon reading the teachings of this specification, those with ordinary skill in the art will now understand that, under appropriate circumstances, considering such issues as advances in technology, user preference, etc., other deployers, such as a motorized reel, etc., may suffice.

Figure 2:
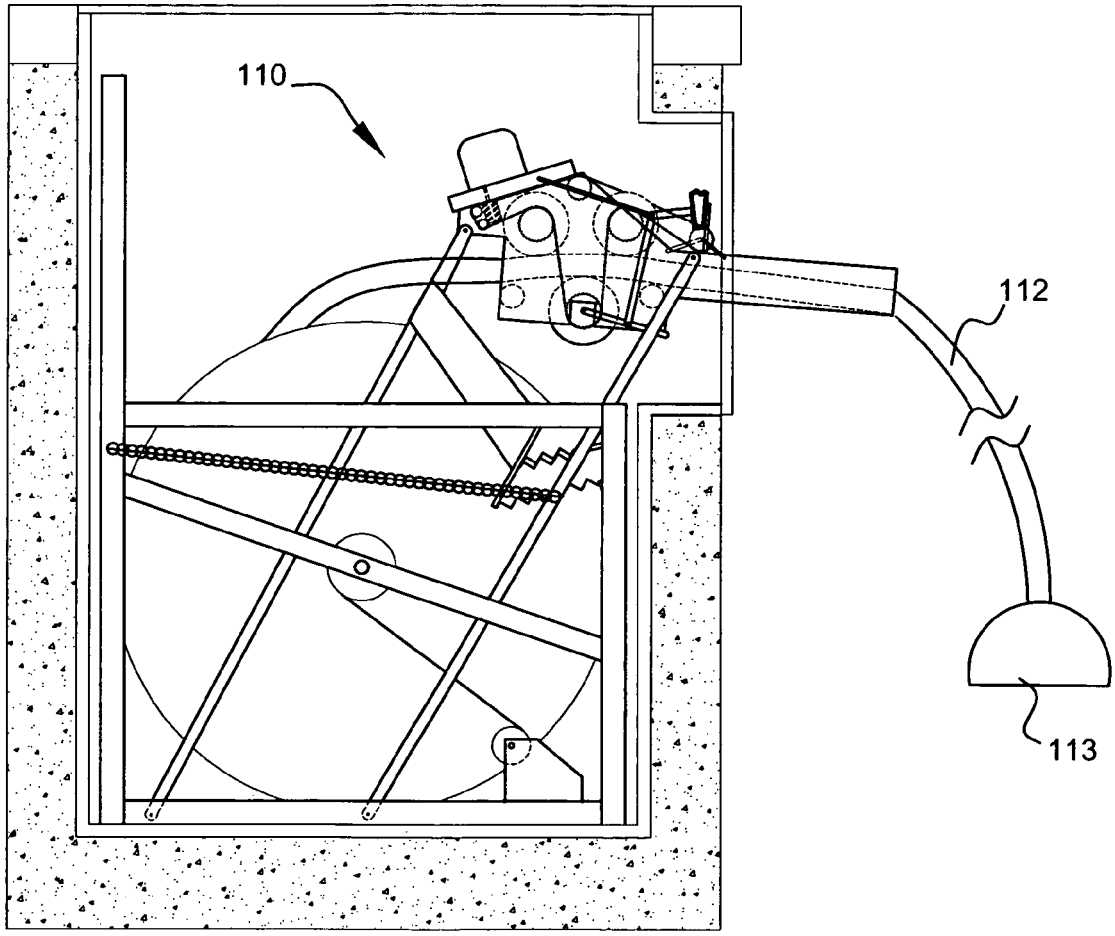
FIG. 2 shows a side plan view of the automatic vacuum assembly according to FIG. 1, in a deployed position.

Preferably, carriage 230 comprises four carriage bars 231, which are each pivotally connected to housing 234 at one end, and to chassis 111 at the other end, as shown. Preferably, carriage 230 moves from the upright, retracted position shown into a tilted, deployed position (as shown in FIG. 2) when pulled by deployment bellows 232. Upon reading the teachings of this specification, those with ordinary skill in the art will now understand that, under appropriate circumstances, considering such issues as advances in technology, user preference, etc., other arrangements, such as other numbers of carriage bars, other types of carriages, motorized carriage movement, other types of carriage movement such as sliding on rails, etc., may suffice.

Preferably, deployment bellows 232 comprise one or more deployment bellows 232, as shown. Preferably, deployment bellows 232 are attached to carriage 230 at one end, preferably with bracket 233, and are attached to chassis 111 at the other end, as shown. Preferably, deployment bellows 232 are also attached to hydraulic system 150, preferably near the end of deployment bellows 232 attached to chassis 111, as shown. Preferably, when vacuum pump 130 is turned on, hydraulic system 150 pulls water out of deployment bellows 232, compressing deployment bellows 232, and pulling carriage 230 forward (as shown in FIG. 2). Upon reading the teachings of this specification, those with ordinary skill in the art will now understand that, under appropriate circumstances, considering such issues as advances in technology, user preference, etc., other types of hydraulic actuators, such as other numbers of bellows, other shapes of bellows, other diameters of bellows, hydraulic pistons, hydraulic motors, etc., may suffice.

Preferably, housing 234 comprises two substantially flat, parallel metal plates 235, which preferably provide structural support for drive system 236 and connection points for carriage 230, as shown. Upon reading the teachings of this specification, those with ordinary skill in the art will now understand that, under appropriate circumstances, considering such issues as advances in technology, user preference, etc., other housings, such as an arrangement of bars, additional enclosed sides, other shapes, other sizes, other materials, etc., may suffice.

Preferably, drive system 236 comprises hydraulic motor 240, drive wheels 242, gears 243, drive chain 244, idle sprocket 246, wheel positioner bellows 247, wheel positioner lever 248, and wheel positioner spring 249, as shown.

Preferably, hydraulic motor 240 comprises a vane-type hydraulic motor of the sort known in the art of hydraulics. Preferably, vacuum pump 130 draws water from inside housing 120 through hydraulic motor 240, causing hydraulic motor 240 to turn and drive gears 243.

Preferably, when vacuum pump 130 is turned on, hydraulic motor 240 drives gears 243, which in turn drive chain 244, which turns drive wheels 242, as shown (at least embodying herein wherein the step of unreeling such at least one hose off of such at least one hose reel in such at least one body of water further comprises the step of using at least one hydraulic motor to unreel such at least one hose off of such at least one hose reel in such at least one body of water). Preferably simultaneously, hydraulic system 150 pulls water out of wheel positioner bellows 247, pivoting wheel positioner lever 248, and moving drive wheels 242 to engage vacuum hose 112 (as shown in FIG. 2). Preferably, drive chain 244 tension is maintained by idle sprocket 246, which is preferably tensioned by sprocket spring 245, as shown. Upon reading the teachings of this specification, those with ordinary skill in the art will now understand that, under appropriate circumstances, considering such issues as advances in technology, user preference, etc., other arrangements, such as a motorized wheel positioner, other methods of engaging the drive wheels with the vacuum hose, gears instead of a drive chain, etc., may suffice.

Preferably, when vacuum pump 130 is turned on, hydraulic system 150 simultaneously powers hydraulic motor 240, retracts wheel positioner bellows 247, and retracts deployment bellows 232, thereby automatically deploying automatic vacuum assembly 110, as shown. Upon reading the teachings of this specification, those with ordinary skill in the art will now understand that, under appropriate circumstances, considering such issues as advances in technology, user preference, etc., other arrangements, such as timing these actions separately, etc., may suffice.

Preferably, when drive wheels 242 are engaged with vacuum hose 112 and are turning, vacuum hose 112 is pulled off of reel 116, and is pushed out into the pool (as shown in FIG. 2). Preferably, this continues until vacuum hose 112 is substantially entirely reeled off of reel 116, as shown.

Preferably, when vacuum hose 112 is fully deployed, hydraulic system 150 automatically switches vacuum pump 130 suction from deployer 114 to vacuum hose 112, as shown, pulling water through vacuum hose 112, preferably to be filtered and returned to the pool (at least embodying herein the step of pulling at least one flow of water through such at least one hose). Preferably, vacuum cleaner 113 is connected to the first end 202 of vacuum hose 112, and is deployed with vacuum hose 112, as shown. Preferably, vacuum cleaner 113 is a vacuum-powered random-motion pool vacuum of the sort known in the art, such as, for example, the Navigator Automatic Pool Cleaner manufactured by Hayward Pool Products, Inc., of Elizabeth, N.J., US. Once deployed, vacuum cleaner 113 preferably cleans the pool until vacuum pump 130 is turned off. Upon reading the teachings of this specification, those with ordinary skill in the art will now understand that, under appropriate circumstances, considering such issues as advances in technology, user preference, etc., other arrangements, such as no vacuum cleaner, a surface skimmer, wand vacuums, etc., may suffice.

Preferably, when vacuum pump 130 is turned off, automatic vacuum assembly 110 automatically retracts, as shown. Preferably, when vacuum pump 130 is turned off, deployment bellows 232 are released from suction and fill with water, permitting retraction spring 252 to pull carriage 230 back into the upright, retracted position, as shown. Preferably simultaneously, wheel positioner bellows 247 is released from suction and fills with water, permitting wheel positioner spring 249 to pull wheel positioner lever 248 to disengage drive wheels 242 from vacuum hose 112, as shown. Preferably, when vacuum hose 112 is released from drive wheels 242, retractor 118 rotates reel 116 counterclockwise to wind vacuum hose 112 onto reel 116, as shown. Upon reading the teachings of this specification, those with ordinary skill in the art will now understand that, under appropriate circumstances, considering such issues as advances in technology, user preference, etc., other arrangements, such as motorized retraction, timed sequences of retraction steps, etc., may suffice.

FIG. 2 shows a side plan view of automatic vacuum assembly 110 according to FIG. 1, in a deployed position. Preferably, when automatic vacuum assembly 110 is deployed, vacuum cleaner 113 is carried far enough away from the wall of the pool that vacuum cleaner 113 does not scrape against the side of the pool during deployment or retraction, as shown.

Figure 3:
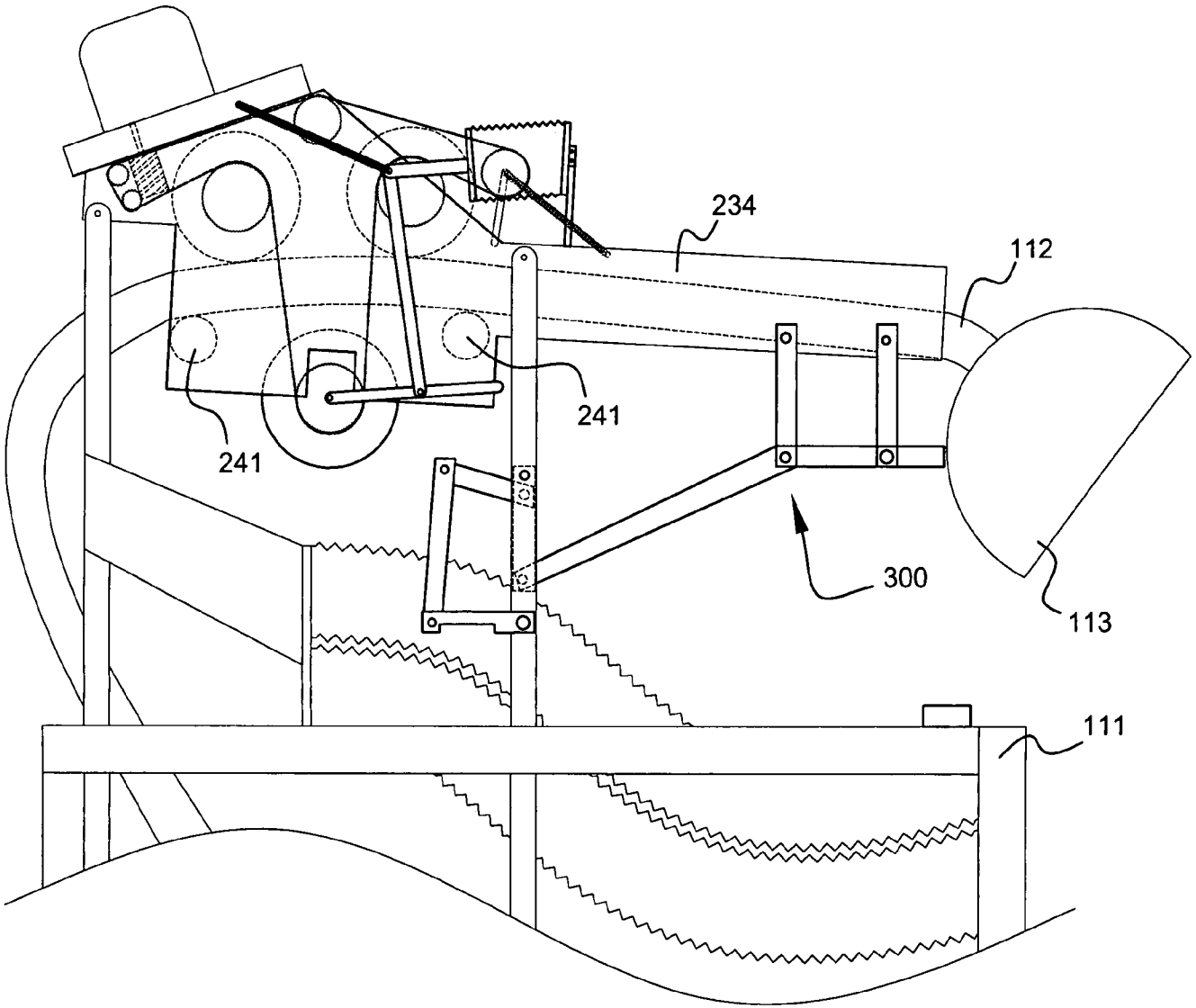
FIG. 3 shows a detail of the upper portion of the automatic vacuum assembly of FIG. 1.

FIG. 3 shows a detail of the upper portion of automatic vacuum assembly 110 of FIG. 1. Preferably, housing 234 supports one or more hose guide wheels 241, as shown, which guide vacuum hose 112, especially during retraction. Retraction sensor 300 is further shown and described in FIGS. 6 and 7. Upon reading the teachings of this specification, those with ordinary skill in the art will now understand that, under appropriate circumstances, considering such issues as advances in technology, user preference, etc., other arrangements, such as other hose guides, other hose guide placements, etc., may suffice.

Figure 4:
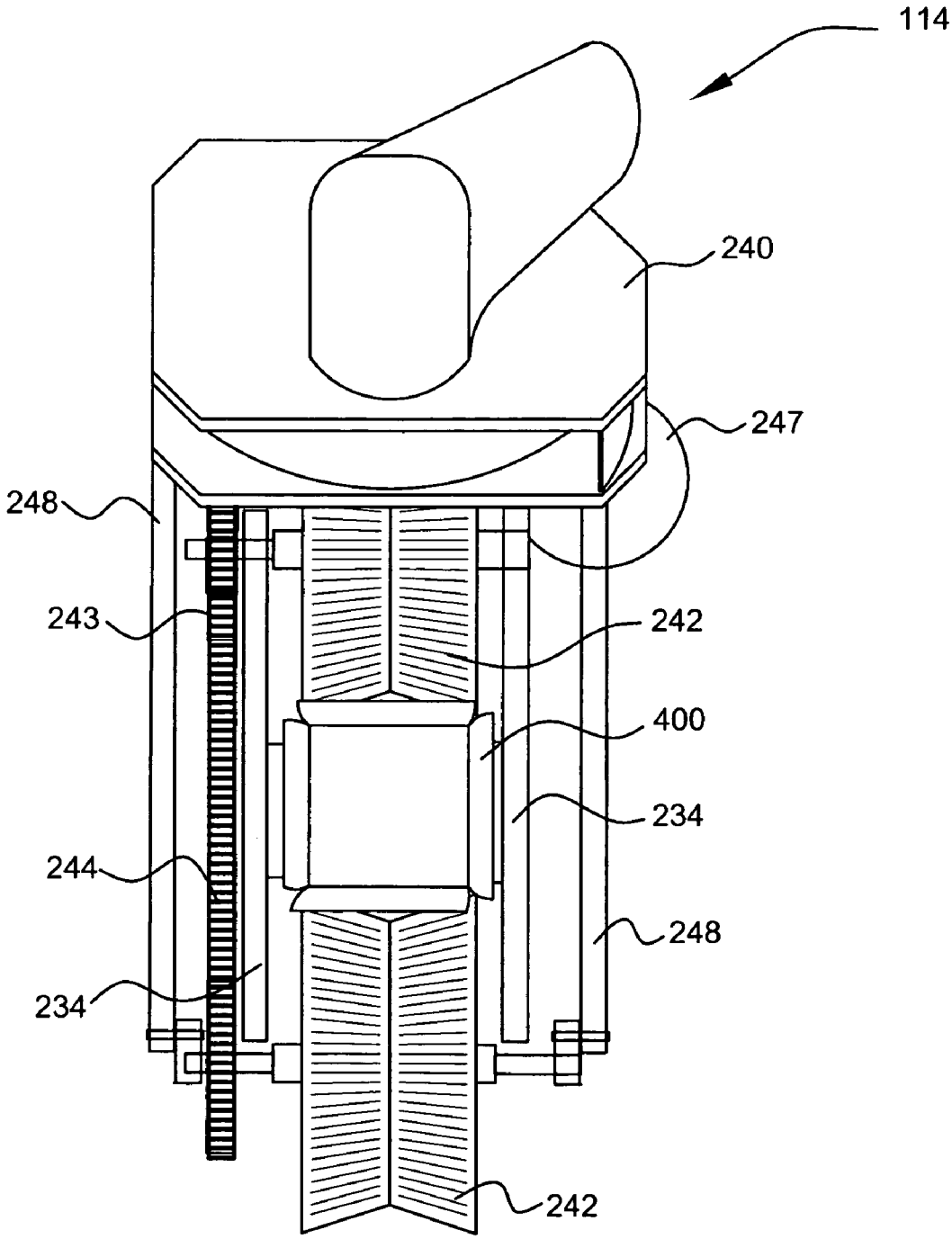
FIG. 4 shows a rear view of the deployer of FIG. 1.

FIG. 4 shows a rear view of deployer 114 of FIG. 1. Preferably, housing 234 comprises hose guide 400, as shown, which is preferably flared at the ends to prevent vacuum hose 112 from catching during deployment, as shown. Upon reading the teachings of this specification, those with ordinary skill in the art will now understand that, under appropriate circumstances, considering such issues as advances in technology, user preference, etc., other arrangements, such as hose guide wheels, etc., may suffice.

Figure 5A:
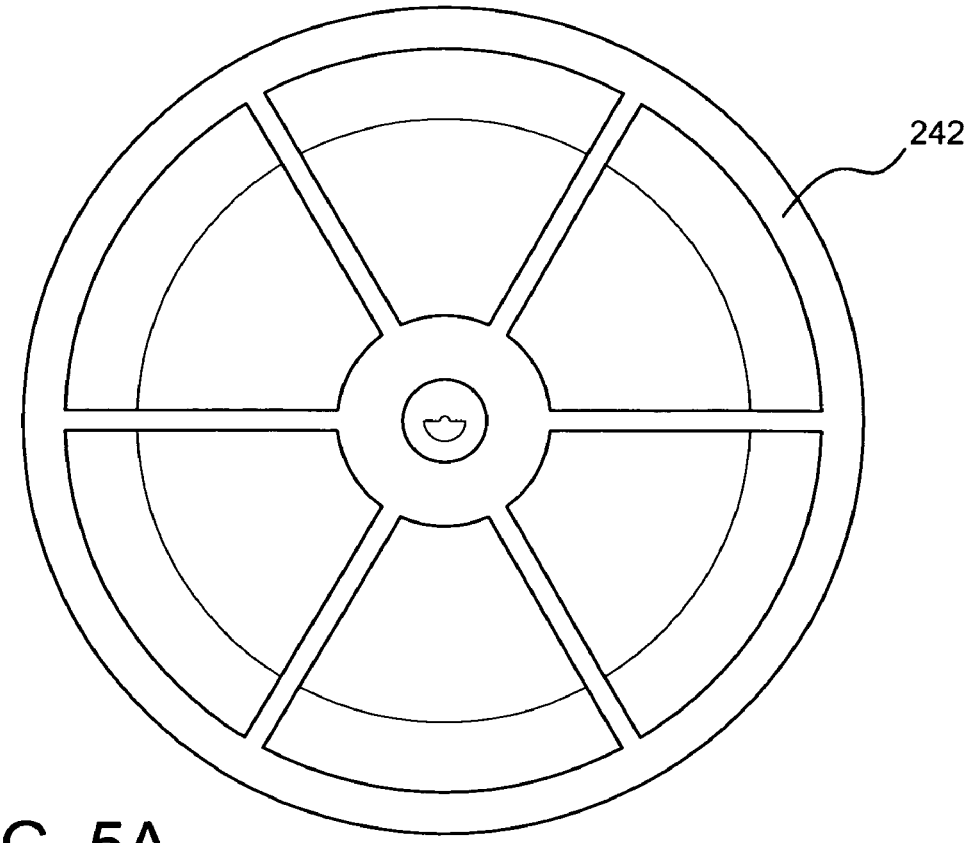
FIG. 5A shows a side view of a drive wheel of FIG. 1.

FIG. 5A shows a side view of a drive wheel 242 of FIG. 1.

Figure 5B:
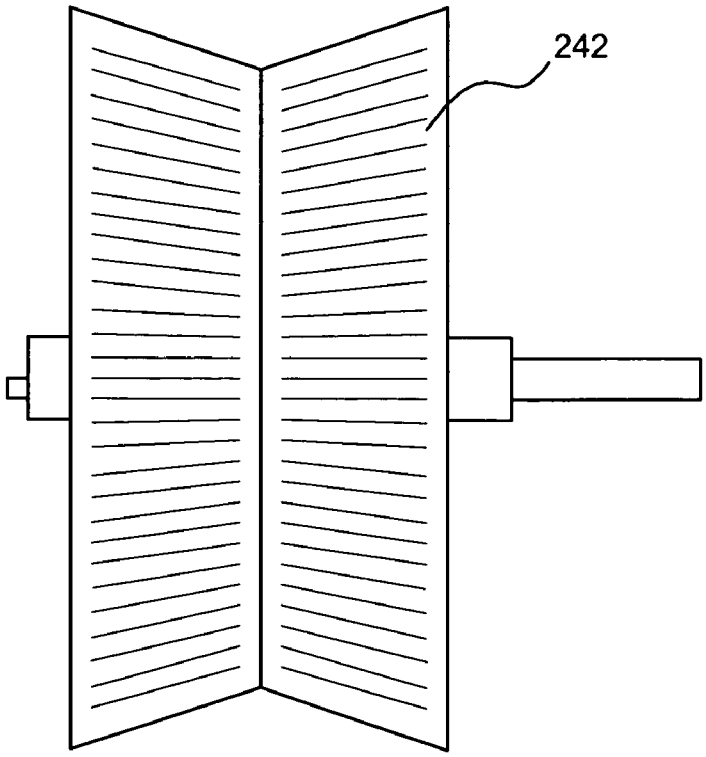
FIG. 5B shows an edge view of the drive wheel of FIG. 5A.

FIG. 5B shows an edge view of the drive wheel 242 of FIG. 5A. Preferably, drive wheel 242 has a v-shaped, ridged interior, as shown, adapted to grip and pull vacuum hose 112. Preferably, drive wheels 242 are molded of plastic, with metal axles. Upon reading the teachings of this specification, those with ordinary skill in the art will now understand that, under appropriate circumstances, considering such issues as advances in technology, user preference, etc., other arrangements, such as pairs of wheels instead of v-shaped wheels, smooth wheels, other sizes of wheels, other wheel materials, etc., may suffice.

Figure 6:
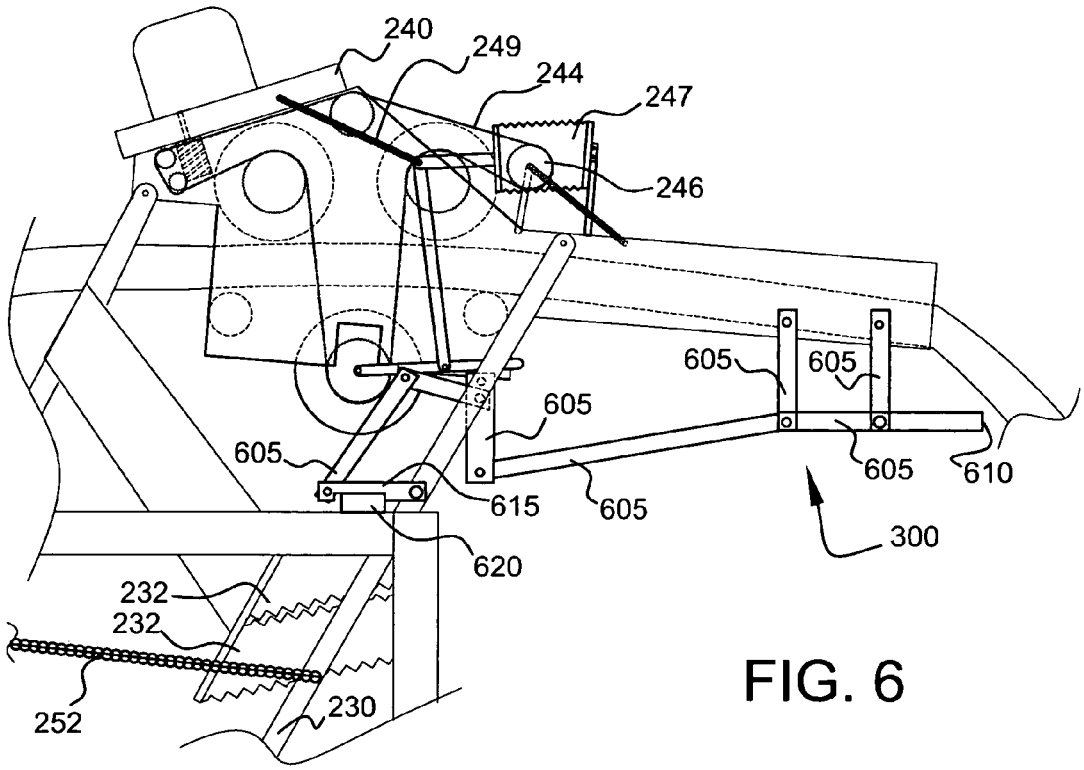
FIG. 6 shows a detail of the upper portion of the automatic vacuum assembly according to FIG. 1, detailing the retraction sensor in a latched position.

FIG. 6 shows a detail of the upper portion of automatic vacuum assembly 110 according to FIG. 1, detailing retraction sensor 300 in a latched position, during vacuum hose 112 retraction. Preferably, retraction sensor 300 comprises a system of levers 605 connecting stopper 610 with latch 615, as shown. Preferably, when carriage 130 is in a deployed position, latch 615 catches on block 620, locking carriage 130 in the deployed position, as shown. Upon reading the teachings of this specification, those with ordinary skill in the art will now understand that, under appropriate circumstances, considering such issues as advances in technology, user preference, etc., other types of retraction sensors, such as electronic sensors, other mechanical sensors, other sensing criteria, etc., may suffice.

Figure 7:
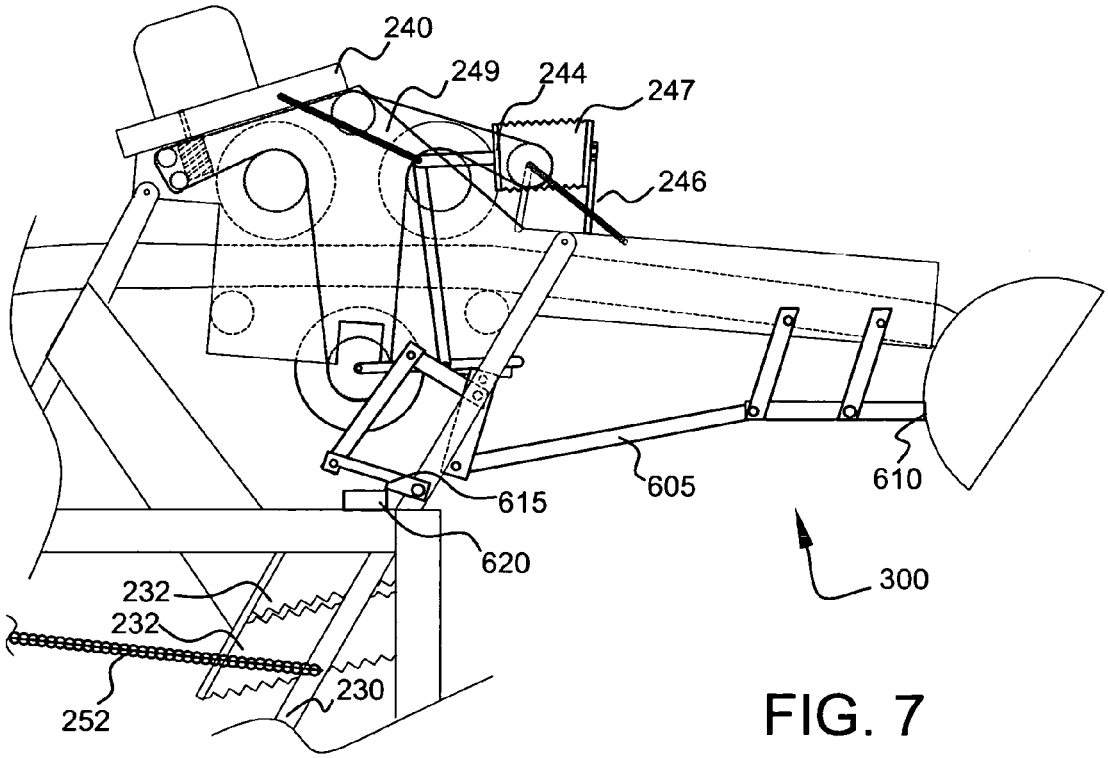
FIG. 7 shows a detail of the upper portion of the automatic vacuum assembly according to FIG. 1, detailing the retraction sensor in an unlatched position.

FIG. 7 shows a detail of the upper portion of automatic vacuum assembly 110 according to FIG. 1, detailing retraction sensor 300 in an unlatched position, after vacuum hose 112 retraction. Preferably, when vacuum hose 112 is fully retracted, vacuum cleaner 113 bumps stopper 610, moving levers 605 and releasing latch 615 from block 620, as shown. Preferably, at this point in the retraction process, deployment bellows 232 has also been released from suction by hydraulic system 150, and retraction spring 252 pulls carriage 230 into the retracted position, as shown. Upon reading the teachings of this specification, those with ordinary skill in the art will now understand that, under appropriate circumstances, considering such issues as advances in technology, user preference, etc., other retraction sensors, such as electronic sensors, other mechanical sensors, other lever arrangements, other types of latches, etc., may suffice.

Figure 8:
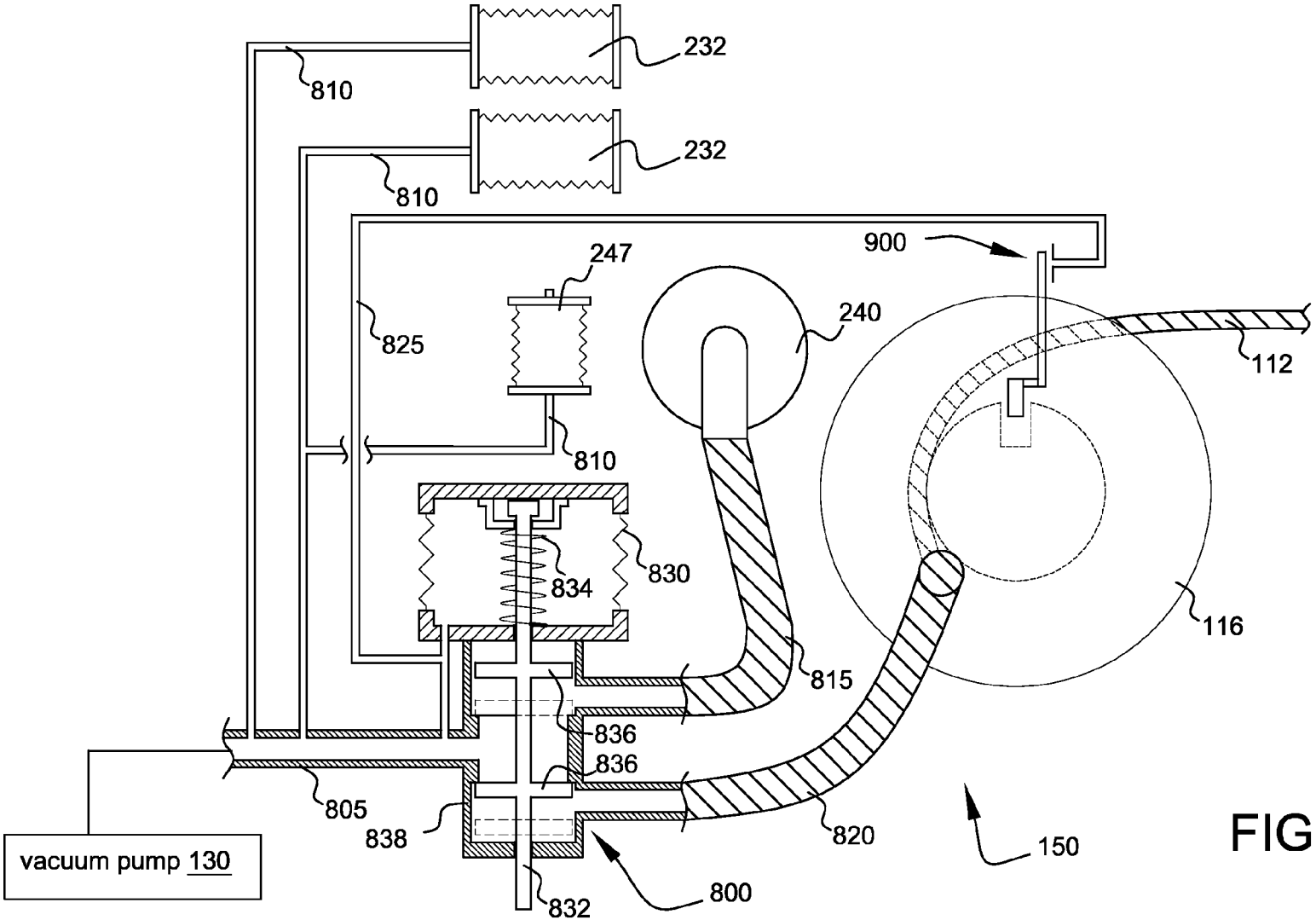
FIG. 8 shows a simplified diagram of a hydraulic system according to a preferred embodiment of the present invention.

FIG. 8 shows a diagram of hydraulic system 150 according to a preferred embodiment of the present invention. Preferably, hydraulic system 150 comprises automatic switch 800, trunk hose 805, bellows hoses 810, hydraulic motor hose 815, vacuum supply hose 820, and deployment sensor hose 825, as shown. Preferably, automatic switch 800 automatically switches the vacuum provided by vacuum pump 130 from deployer 114 to vacuum hose 112 when vacuum hose 112 is fully deployed, as shown. Upon reading the teachings of this specification, those with ordinary skill in the art will now understand that, under appropriate circumstances, considering such issues as advances in technology, user preference, etc., other automatic switches, such as electric valve switches, other types of automatic switch valves, other hose arrangements, etc., may suffice.

Preferably, automatic switch 800 comprises switch bellows 830, piston 832, piston spring 834, valves 836, and chamber 838, as shown. Preferably, two valves 836 are spaced along piston 832 in chamber 838, and slidingly seal against the sides of chamber 838, as shown. Preferably, piston 832 with valves 836 is moved longitudinally within chamber 838 by switch bellows 830, as shown. Upon reading the teachings of this specification, those with ordinary skill in the art will now understand that, under appropriate circumstances, considering such issues as advances in technology, user preference, etc., other arrangements, such as flapper valves, multiple valve bellows, electronic switches, etc., may suffice.

Preferably, trunk hose 805 connects to chamber 838 between valves 836 at one end, and connects to vacuum pump 130 at the other end, as shown. Preferably, hydraulic motor hose 815 connects to chamber 838 so that hydraulic motor hose 815 communicates with trunk hose 805 when switch bellows 830 is extended, as shown. Preferably, piston spring 834 acts to keep switch bellows 830 extended, as shown. Preferably, vacuum supply hose 820 connects to chamber 838 so that vacuum supply hose 820 communicates with trunk hose 805 when switch bellows 830 is compressed, as shown in hidden lines. Upon reading the teachings of this specification, those with ordinary skill in the art will now understand that, under appropriate circumstances, considering such issues as advances in technology, user preference, etc., other arrangements, such as other hose routings, other numbers of hoses, other hose connections, etc., may suffice.

Preferably, bellows hoses 810 are connected to trunk hose 805 so that bellows hoses 810 are under vacuum whenever vacuum pump 130 is on, as shown. Preferably, bellows hoses 810 connect to deployment bellows 232 and wheel positioner bellows 247, so that deployment bellows 232 and wheel positioner bellows 247 are under vacuum whenever vacuum pump 130 is on, as shown. Upon reading the teachings of this specification, those with ordinary skill in the art will now understand that, under appropriate circumstances, considering such issues as advances in technology, user preference, etc., other arrangements, such as latches to keep the bellows compressed during vacuuming, etc., may suffice.

Figure 11:
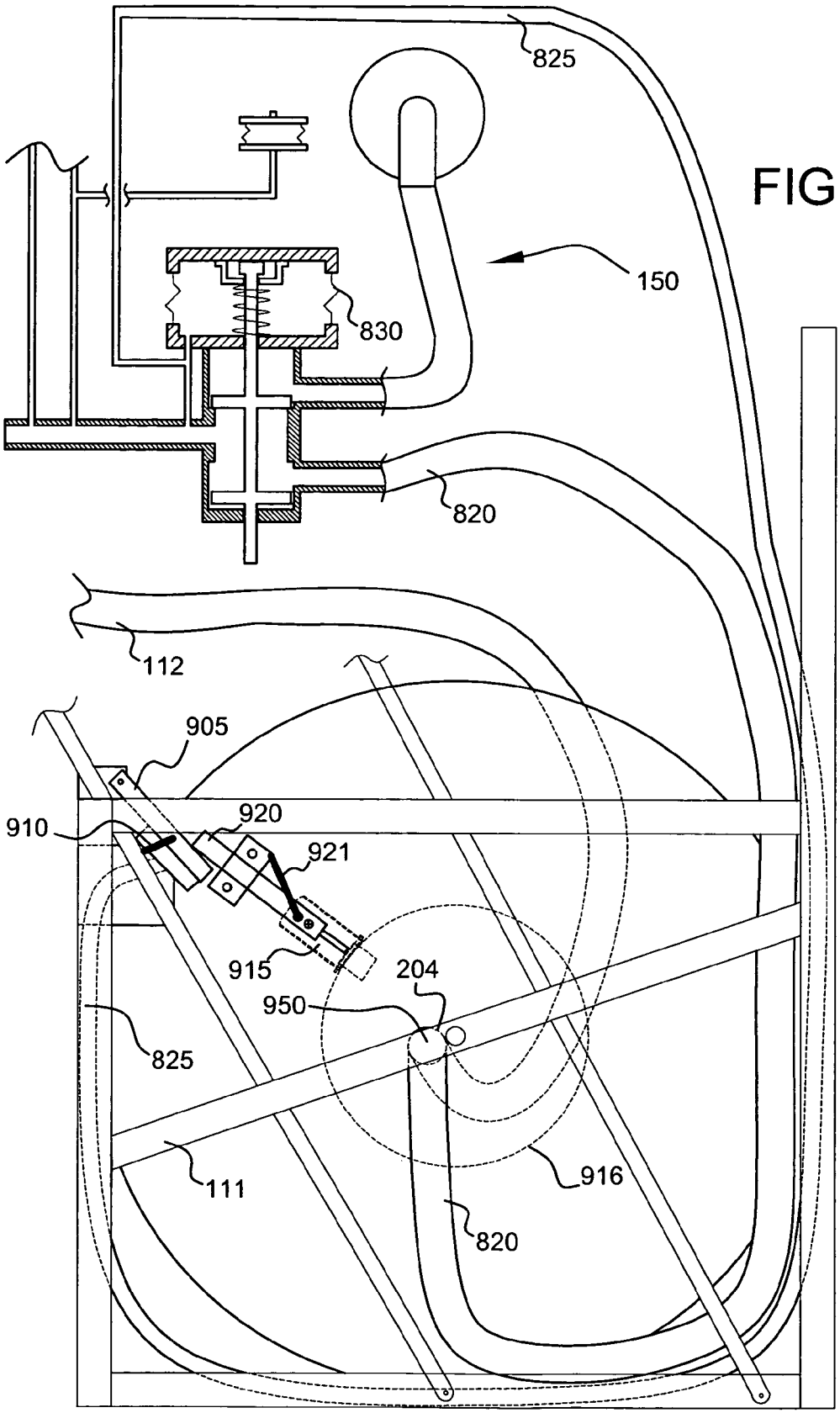
FIG. 11 shows a diagram of the state of the hydraulic system during vacuuming.

Preferably, deployment sensor hose 825 is crosslinked between trunk hose 805 and switch bellows 830, as shown, so that deployment sensor hose 825 is under vacuum whenever vacuum pump 130 is on. Preferably, deployment sensor hose 825 is open to water at the far end when vacuum hose 112 is reeled on reel 116, as shown in FIG. 9. Preferably, deployment sensor hose 825 is closed at the far end when vacuum hose 112 is substantially unreeled from reel 116 (i.e., when vacuum hose 112 is fully deployed), as shown in FIG. 11. Preferably, when deployment sensor hose 825 is closed at the far end, suction is applied to switch bellows 830, compressing switch bellows 830 and moving valves 836 so that vacuum supply hose 820 communicates with trunk hose 805, as shown, so that pool vacuuming automatically begins (at least embodying herein wherein such step of automatically switching further comprises the step of actuating at least one liquid-actuated bellows). Upon reading the teachings of this specification, those with ordinary skill in the art will now understand that, under appropriate circumstances, considering such issues as advances in technology, user preference, etc., other arrangements, such as other types of deployment sensors, etc., may suffice.

FIG. 9 shows a diagram of the state of hydraulic system 150 during vacuum hose 112 deployment, with sprung lever 915 depressed. Preferably, automatic vacuum assembly 110 comprises hose deployment sensor 900, as shown. Preferably, hose deployment sensor 900 comprises deployment sensor hose 825, sensor hose stopper 905, hose stopper spring 910, sprung lever 915, and sprung bar 920, as shown. Preferably, sprung lever 915 lies across reel hub 916, so that sprung lever 915 is compressed when vacuum hose 112 is wound around reel hub 916 and over sprung lever 915, as shown, and so that sprung lever 915 is released into an upward slanted position when vacuum hose 112 is wound off of sprung lever 915, as shown. Preferably, one end of sprung lever 915 is hinged and sprung, and the other end of sprung lever 915 is connected to the lower end of sprung bar 920, as shown, preferably through a slot in reel 116, as shown.

Preferably, sprung bar 920 is radially mounted on the outside of reel 116, as shown. Preferably, sprung bar 920 is in a lowered position when sprung lever 915 is compressed, and is pulled into a raised position (away from reel hub 916) by sprung lever 915 and bar spring 921 when sprung lever 915 is released (as shown in FIG. 10, and shown in cross-section in FIG. 14).

Preferably, when sprung bar 920 is lowered, the top end of sprung bar 920 does not touch sensor hose stopper 905 as reel 116 turns. Preferably, when sprung bar 920 is raised, the top end of sprung bar 920 presses hose stopper 905 against the open end of deployment sensor hose 825 as reel 116 turns, sealing the end of deployment sensor hose 825 (as shown in FIG. 11) and causing suction to be applied to switch bellows 830.

Preferably, when sprung bar 920 presses hose stopper 905 against the open end of deployment sensor hose 825, the rotation of reel 116 is stopped at that point, as shown. Preferably, the second end 204 of vacuum hose 112 is connected to an opening 950 in reel 116 near axle 210, as shown. Preferably, vacuum supply hose 820 is fixed to chassis 111, with the end of vacuum supply hose 820 flush with the exterior of reel 116, as shown. Preferably, when sprung bar 920 presses hose stopper 905 against the open end of deployment sensor hose 825 and reel 116 is stopped in that position, the end of vacuum supply hose 820 aligns with opening 950 which communicates with vacuum hose 112 (as shown in FIG. 11), thereby connecting vacuum supply hose 820 to vacuum hose 112, as shown (at least embodying herein further comprising the step of automatically switching such at least one vacuum pump from pulling water through such at least one hydraulic motor to pulling water through such at least one vacuum hose after such at least one vacuum hose is unreeled from such at least one reel). Upon reading the teachings of this specification, those with ordinary skill in the art will now understand that, under appropriate circumstances, considering such issues as advances in technology, user preference, etc., other arrangements, such as a swivel joint inlet on the axle connecting the vacuum hose to the vacuum supply hose, etc., may suffice.

Figure 10:
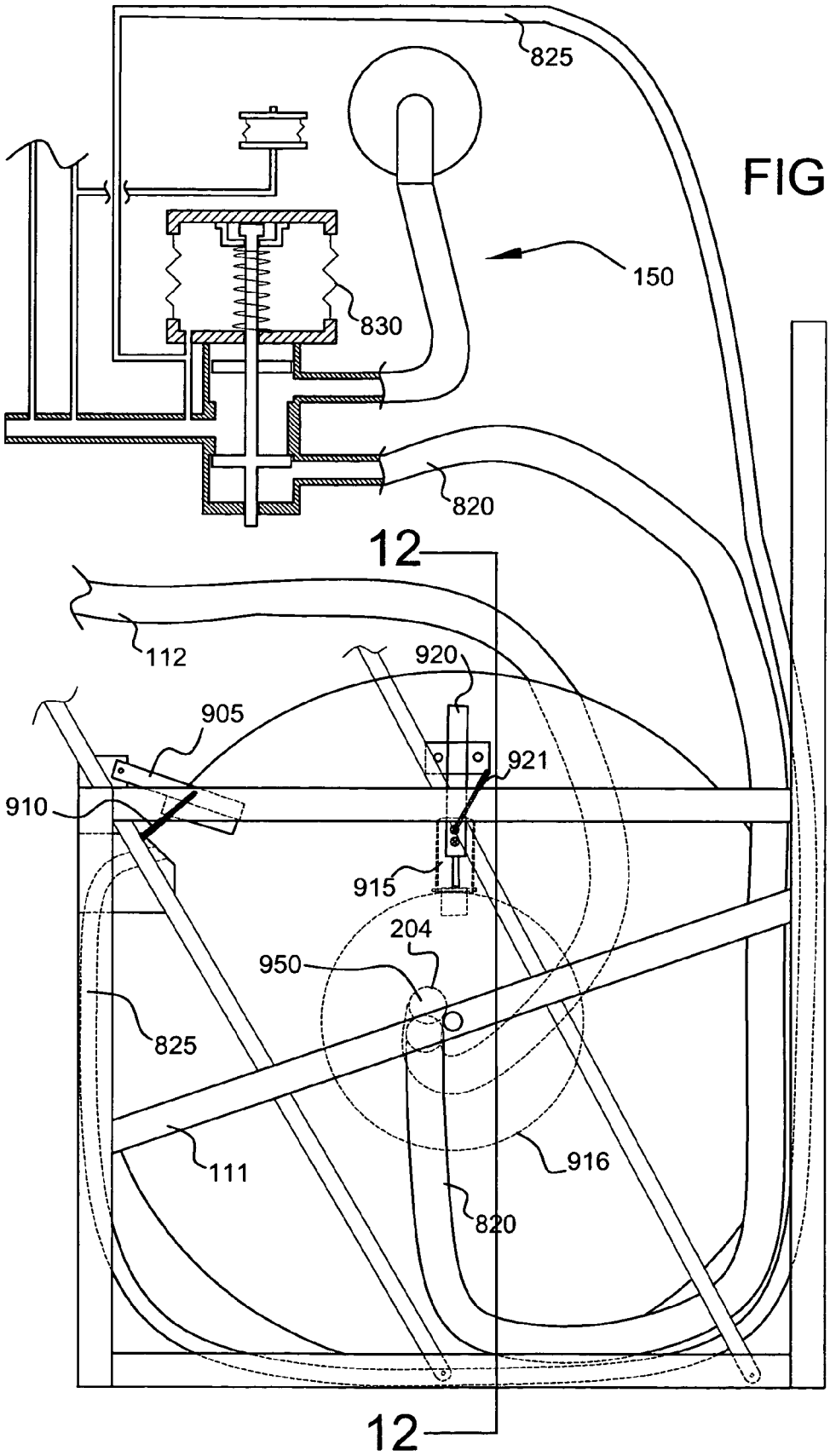
FIG. 10 shows a diagram of the state of the hydraulic system during vacuum hose deployment, with the hose deployment sensor lever released.

FIG. 10 shows a diagram of the state of hydraulic system 150 during vacuum hose 112 deployment, with sprung lever 915 released.

FIG. 11 shows a diagram of the state of hydraulic system 150 during vacuuming.

Figure 12:
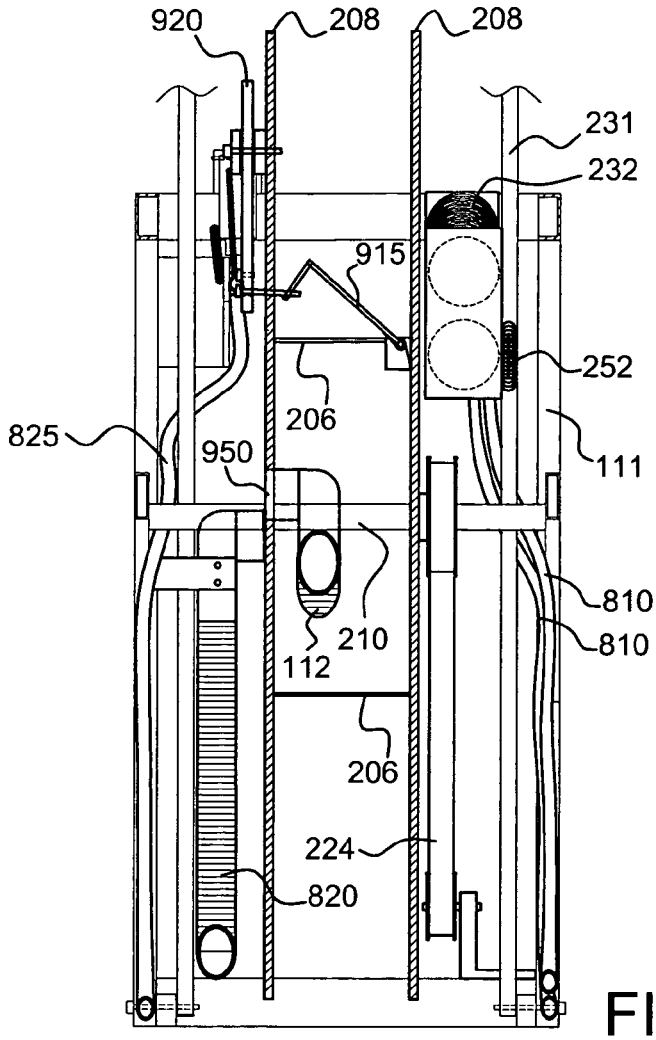
FIG. 12 shows a cross-section through section 12-12 of FIG. 10.

FIG. 12 shows a cross-section through section 12-12 of FIG. 10.

FIG. 13 shows detail 13 of FIG. 12, exploded, with reel 116 moved aside to clearly show the workings of hose deployment sensor 900. Preferably, sprung lever 915 comprises bracket 1305, hinge 1307, spring 1310, lever 1315, and arm 1320, as shown. Preferably, bracket 1305 connects lever 1315 to reel 116, through hinge 1307, as shown. Preferably, spring 1310 holds lever 1315 up when lever 1315 is not compressed by vacuum hose 112, as shown.

Preferably, sprung bar 920 comprises bar 1330, bolt 1335, spacer 1340, bracket 1345, and spring 1350, as shown. Preferably, bar 1330 slides freely between spacer 1340 and bracket 1345, as shown. Preferably, spring 1350 connects at one end to bracket 1345, and at the other end to the lower portion of bar 1330, so that spring 1350 pulls bar 1330 upward (away from reel hub 916) when sprung lever 915 is released, as shown.

Preferably, sprung lever 915 is connected to bar 1330 by bolt 1335, as shown. Preferably, the bolt-hole in arm 1320 is loose, to accommodate various angles of intersection of arm 1320 and bolt 1335, as shown. Upon reading the teachings of this specification, those with ordinary skill in the art will now understand that, under appropriate circumstances, considering such issues as advances in technology, user preference, etc., other arrangements, such as hinged connections, etc., may suffice.

Preferably, hose stopper 905 comprises bracket 1360, hinge 1365, lever 1370, pad 1375, and spring 1380, as shown. Preferably, deployment sensor hose 825 is supported by bracket 1390 and strap 1391, as shown.

Preferably, bracket 1360 is fixedly connected to chassis 111, as shown, and is connected to lever 1370 by hinge 1365, as shown. Preferably, lever 1370 is held away from the end of deployment sensor hose 825 by spring 1380, as shown. Preferably, pad 1375 is attached to the underside of lever 1370, as shown. Preferably, pad 1375 comprises a resilient, water-resistant material able to seal against the end of deployment sensor hose 825 when lever 1370 is pressed down by sprung bar 920. More preferably, pad 1375 comprises polyurethane foam. Upon reading the teachings of this specification, those with ordinary skill in the art will now understand that, under appropriate circumstances, considering such issues as advances in technology, user preference, etc., other arrangements, electronic sensors, electronic valve switches, other pad materials, other types of deployment sensors, etc., may suffice.

Figure 14:
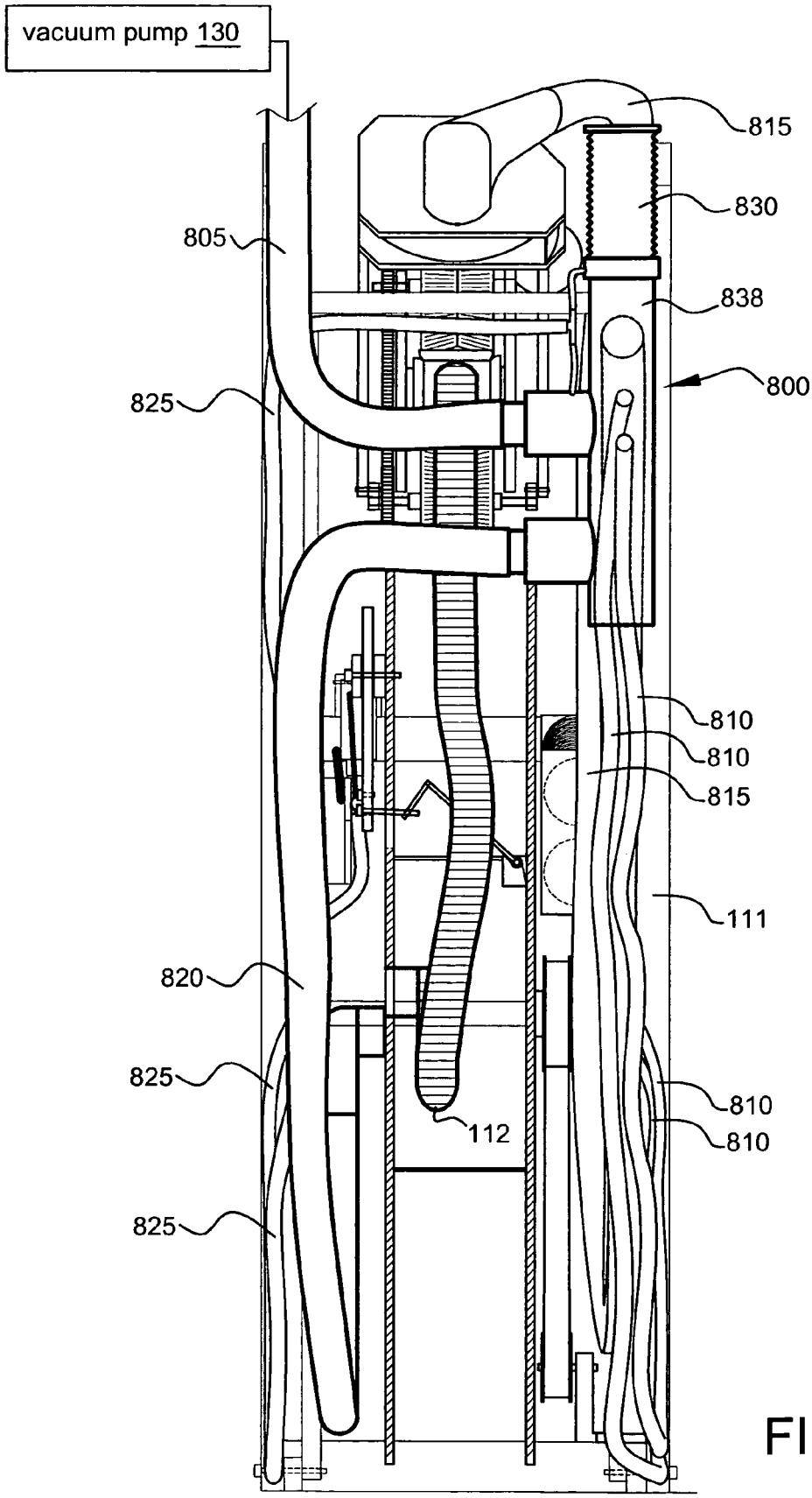
FIG. 14 shows a rear view of the embodiment according to FIG. 1.

FIG. 14 shows a rear view of the embodiment according to FIG. 1. Preferably, chamber 838 is constructed from PVC pipe sections. Preferably, vacuum hose 112 is attached to reel 116 with a 90-degree PVC pipe fitting, as shown. Preferably, vacuum hose 112 is attached to reel 116 with a 90-degree PVC pipe fitting, as shown. Preferably, hydraulic motor hose 815 is attached to hydraulic motor 240 with a 90-degree PVC pipe fitting, as shown. Preferably, vacuum supply hose 820 is attached to chassis 111 adjacent reel 116 with a 90-degree PVC pipe fitting, as shown. Upon reading the teachings of this specification, those with ordinary skill in the art will now understand that, under appropriate circumstances, considering such issues as advances in technology, user preference, etc., other arrangements, such as other types of pipe fittings, custom parts manufactured, other materials, etc., may suffice.

In this preferred alternate embodiment, bellows hoses 810 are connected to chamber 838 adjacent trunk hose 805, as shown, instead of directly to trunk hose 805, as was shown in FIG. 8. This arrangement functions in the same way as was described in FIG. 8.

Figure 15:
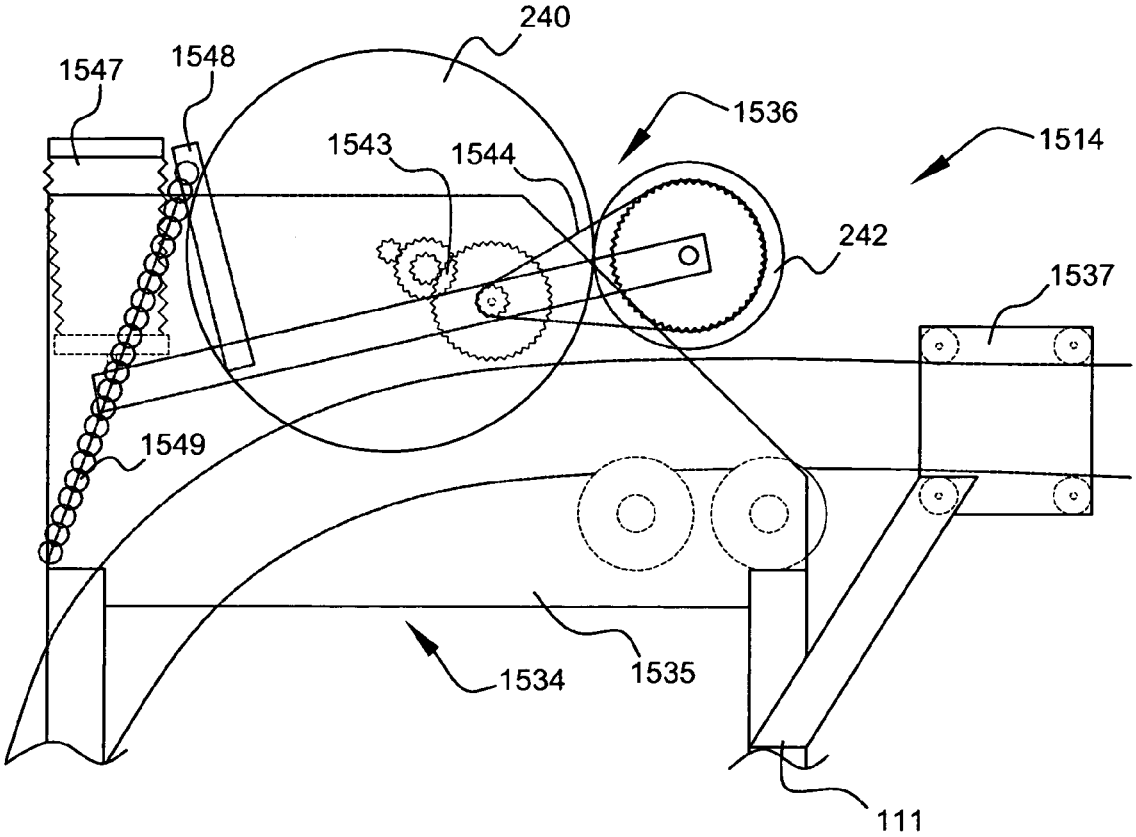
FIG. 15 shows a side view of a deployer according to another preferred embodiment of the present invention, in a non-deploying state.

FIG. 15 shows a side view of deployer 1514 according to another preferred embodiment of the present invention, in a non-deploying state. Preferably, deployer 1514 comprises housing 1534 and drive system 1536, as shown.

Preferably, housing 1534 comprises two substantially flat, parallel metal plates 1535, as shown, which preferably provide structural support for drive system 1536 and connection points for chassis 111, as shown. Preferably, housing 1534 is fixedly connected to chassis 111, preferably near door 122. Therefore, in this preferred embodiment, deployment bellows 232 and retraction sensor 300 are not required.

Preferably, housing 1534 comprises hose guide 1537. Preferably, hose guide 1537 is fixedly attached to chassis 111. Upon reading the teachings of this specification, those with ordinary skill in the art will now understand that, under appropriate circumstances, considering such issues as advances in technology, user preference, etc., other arrangements, such as a hose guide that extends when the door is opened, a hose guide that extends when the hose is deployed, etc., may suffice.

Preferably, drive system 1536 comprises hydraulic motor 240, drive wheel 242, gears 1543, drive chain 1544, wheel positioner bellows 1547, wheel positioner lever 1548, and wheel positioner spring 1549, as shown.

Vacuum supply hose 815 is attached to hydraulic motor 140, but is not shown.

Figure 16:
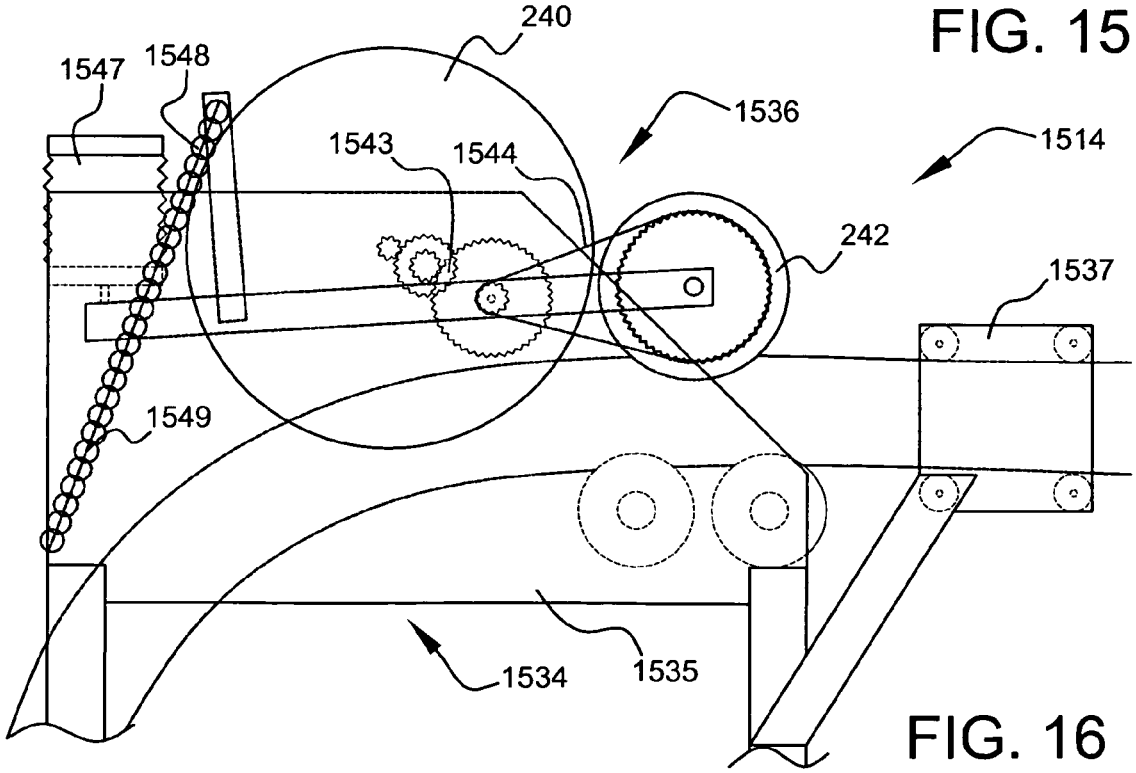
FIG. 16 shows a side view of the deployer according to FIG. 15, in a deploying state.

FIG. 16 shows a side view of deployer 1514 according to FIG. 16, in a deploying state. Preferably, when vacuum pump 130 is turned on, hydraulic motor 240 drives gears 1543, which in turn drive chain 1544, which turns drive wheel 242, as shown. Preferably simultaneously, hydraulic system 150 pulls water out of wheel positioner bellows 1547, pivoting wheel positioner lever 1548, and moving drive wheel 242 to engage vacuum hose 112, as shown (at least embodying herein wherein the step of using at least one hydraulic motor to unreel such at least one hose off of such at least one hose reel in such at least one body of water further comprises the step of using at least one vacuum pump to pull water through such at least one hydraulic motor).

Preferably, when vacuum pump 130 is turned off, wheel positioner spring 1549 pulls wheel positioner lever 1548 to disengage drive wheel 242 from vacuum hose 112, returning deployer 1514 to the state shown in FIG. 15, as shown.

Although applicant has described applicant's preferred embodiments of this invention, it will be understood that the broadest scope of this invention includes modifications such as diverse shapes, sizes, and materials. Such scope is limited only by the below claims as read in connection with the above specification.

Further, many other advantages of applicant's invention will be apparent to those skilled in the art from the above descriptions and the below claims.

EMBODIMENTS

Vacuum hose 112 at least embodies herein vacuum hose means for providing at least one vacuum hose having at least one first end and at least one second end; and at least embodies herein at least one vacuum hose adapted to provide at least one vacuum hose having at least one first end and at least one second end.

Vacuum cleaner 113 at least embodies herein wherein such at least one vacuum hose further comprises at least one vacuum cleaner adapted to provide at least one vacuum cleaner, wherein such at least one vacuum cleaner is attached to such at least one first end of such at least one vacuum hose.

Deployer 114 at least embodies herein hose deployer means for deploying such at least one first end of such vacuum hose means into the at least one pool of water; and at least embodies herein at least one hose deployer adapted to deploy such at least one first end of such at least one vacuum hose into such at least one pool of water; and at least embodies herein wherein such at least one hose deployer comprises at least one automatic hose deployer adapted to automatically deploy such at least one vacuum hose when such at least one vacuum pump is turned on; and at least embodies herein wherein such at least one vacuum pump simultaneously powers such at least one articulated carrier and such at least one hose deployer.

Reel 116 at least embodies herein hose reel means for providing at least one hose reel for such vacuum hose means; and at least embodies herein at least one hose reel adapted to provide at least one hose reel for such at least one vacuum hose.

Retractor 118 at least embodies herein hose retractor means for retracting such vacuum hose means onto such hose reel means; and at least embodies herein at least one hose retractor adapted to retract such at least one vacuum hose onto such at least one hose reel; and at least embodies herein wherein such at least one hose retractor comprises at least one automatic hose retractor adapted to automatically retract such at least one vacuum hose when such at least one vacuum pump is turned off.

Housing 120 at least embodies herein filler means for providing for such vacuum hose means to remain continuously full of water; and at least embodies herein at least one filler adapted to provide for such at least one vacuum hose to remain continuously full of water; and at least embodies herein wherein such at least one filler further comprises at least one housing adapted to provide at least one housing adapted to contain such at least one vacuum hose, on such reel means, below such at least one waterline of such at least one pool of water; and at least embodies herein wherein such at least one vacuum hose is entirely within such at least one housing when such at least one vacuum hose is in a retracted position.

Door 122 at least embodies herein wherein such at least one housing further comprises at least one door adapted to provide at least one exit from such at least one housing into such at least one pool of water; and at least embodies herein wherein such at least one door is below such at least one waterline of such at least one pool of water.

Vacuum pump 130 at least embodies herein vacuum pump means for providing at least one vacuum pump, wherein such vacuum pump means is attached to such at least one second end of such vacuum hose means; and at least embodies herein at least one vacuum pump adapted to provide at least one vacuum pump, wherein such at least one vacuum pump is attached to such at least one second end of such at least one vacuum hose; and at least embodies herein at least one vacuum pump adapted to provide at least one vacuum pump.

Carriage 230 at least embodies herein wherein such at least one hose deployer comprises at least one articulated carrier adapted to carry such at least one hose deployer from at least one retracted position to at least one deployed position and vice versa.

Deployment bellows 232 at least embodies herein wherein such at least one vacuum pump powers such at least one articulated carrier; and at least embodies herein wherein such at least one hose deployer comprises at least one hydraulic actuator.

Drive system 236 at least embodies herein at least one drive adapted to drive such at least one hose-moving wheel off of such at least one hydraulic motor.

Hydraulic motor 240 at least embodies herein wherein such at least one hose deployer is powered by such at least one vacuum pump; and at least embodies herein at least one hydraulic motor adapted to power at least one motor with water moved by such at least one vacuum pump; and at least embodies herein wherein such at least one hose deployer is powered by such at least one hydraulic motor; and at least embodies herein at least one hydraulic motor adapted to provide at least one hydraulic motor; and at least embodies herein wherein such at least one hydraulic motor is powered by such at least one vacuum pump; and at least embodies herein at least one hydraulic motor adapted to provide at least one hydraulic motor.

Hose guide wheels 241 at least embodies herein at least one hose-guiding wheel adapted to guide such at least one vacuum hose; and at least embodies herein at least one hose-guiding wheel adapted to guide at least one hose.

Drive wheels 242 at least embodies herein at least one hose-moving wheel adapted to move such at least one vacuum hose; and at least embodies herein wherein such at least one hose-guiding wheel comprises such at least one hose-moving wheel; a and at least embodies herein at least one hose-moving wheel adapted to move such at least one hose.

Drive chain 244 at least embodies herein wherein such at least one drive comprises at least one drive chain; and at least embodies herein at least one drive adapted to drive such at least one hose-moving wheel off of such at least one hydraulic motor.

Idle sprocket 246 at least embodies herein further comprising at least one drive tensioner adapted to provide consistent tension to such at least one drive chain.

Wheel positioner bellows 247 at least embodies herein wherein such at least one wheel compressor is actuated by such at least one vacuum pump; and at least embodies herein wherein such at least one wheel tensioner is tensioned by such at least one vacuum pump; and at least embodies herein wherein such at least one hose deployer comprises at least one hydraulic actuator.

Wheel positioner lever 248 at least embodies herein at least one wheel compressor adapted to compress such at least one vacuum hose between such at least one hose-guiding wheel and such at least one hose-moving wheel; and at least embodies herein at least one wheel tensioner adapted to tension such at least one hose between such at least one hose-guiding wheel and such at least one hose-moving wheel.

Retraction spring 252 at least embodies herein wherein such at least one hose retractor comprises at least one spring adapted to wind such at least one hose reel.

Retraction sensor 300 at least embodies herein at least one retraction detector adapted to detect the complete retraction of such at least one vacuum hose onto such at least one reel; and at least embodies herein wherein such at least one articulated carrier is adapted to carry such at least one hose deployer from at least one deployed position to at least one retracted position when such at least one retraction detector detects the complete retraction of such at least one vacuum hose onto such at least one reel.

Automatic switch 800 at least embodies herein at least one automatic switch adapted to automatically switch such at least one vacuum pump from powering such at least one hose deployer to pulling water through such at least one vacuum hose after such at least one hose deployer deploys such at least one vacuum hose; and at least embodies herein wherein such at least one hose deployer is powered by such at least one vacuum pump prior to such at least one deployment detector detecting the finished deployment of such at least one vacuum hose off of such at least one reel; and at least embodies herein wherein such at least one vacuum pump pulls water through such at least one vacuum hose after such at least one deployment detector detects the finished deployment of such at least one vacuum hose off of such at least one reel; and at least embodies herein at least one automatic switch adapted to automatically switch such at least one vacuum pump from powering such at least one hose deployer to pulling water through such at least one vacuum hose after such at least one deployment detector detects the finished deployment of such at least one vacuum hose off of such at least one reel; and at least embodies herein at least one automatic switch adapted to automatically switch such at least one vacuum pump from powering such at least one hose deployer to pulling water through such at least one vacuum hose after such at least one spring-loaded switch is closed.

Switch bellows 830 at least embodies herein wherein such at least one automatic switch comprises at least one hydraulic actuator.

Hose deployment sensor 900 at least embodies herein at least one deployment detector adapted to detect the finished deployment of such at least one vacuum hose off of such at least one reel.

Hose stopper 905 at least embodies herein at least one spring-loaded switch adapted to provide at least one spring-loaded switch wherein such at least one spring-loaded switch is open when such at least one spring-loaded bar is pulled into such at least one retracted position; and wherein such at least one spring-loaded switch is closed when such at least one spring-loaded bar is released into such at least one extended position and contacts such at least one spring-loaded switch.

Sprung lever 915 at least embodies herein at least one spring-loaded lever adapted to provide at least one spring-loaded lever on the interior of such at least one reel wherein such at least one spring-loaded lever is compressed when such at least one vacuum hose presses such at least one spring-loaded lever; and wherein such at least one spring-loaded lever is released when such at least one vacuum hose is removed from such at least one spring-loaded lever.

Sprung bar 920 at least embodies herein at least one spring-loaded bar adapted to provide at least one spring-loaded bar on the exterior of such at least one reel wherein such at least one spring-loaded bar is pulled into at least one retracted position when such at least-one spring-loaded lever is compressed; and wherein such at least one spring-loaded bar means is released into at least one extended position when such at least one spring-loaded lever is released.

What is claimed is:

1. A cleaning system, relating to automatic vacuum means relating to cleaning at least one pool of water, comprising:

a) vacuum hose means for providing at least one vacuum hose having at least one first end and at least one second end;

b) hose reel means for reeling said vacuum hose means;

c) hose deployer means for deploying said at least one first end of said vacuum hose means into the at least one pool of water; and d) hose retractor means for retracting said vacuum hose means onto said hose reel means;

e) wherein said vacuum hose means is adapted to remain continuously full of water when retracted onto said hose reel means; and f) wherein said at least one hose retractor means comprises at least one automatic hose retractor means for automatically retracting said at least one vacuum hose means when at least one vacuum pump is turned off.

2. A cleaning system, relating to at least one automatic vacuum relating to cleaning at least one pool of water having at least one waterline, comprising:

a) at least one vacuum hose having at least one first end and at least one second end;

b) at least one vacuum pump, wherein said at least one vacuum pump is attached to said at least one second end of said at least one vacuum hose;

c) at least one hose reel adapted to reel said at least one vacuum hose;

d) at least one hose deployer adapted to deploy said at least one first end of said at least one vacuum hose into such at least one pool of water; and e) at least one hose retractor adapted to retract said at least one vacuum hose onto said at least one hose reel;

f) wherein said at least one vacuum hose is adapted to remain continuously full of water when retracted onto said at least one hose reel;

g) wherein said at least one hose retractor comprises at least one automatic hose retractor adapted to automatically retract said at least one vacuum hose when said at least one vacuum pump is turned off.

3. The cleaning system, according to claim 2, wherein said at least one hose deployer comprises at least one hydraulic actuator.

4. The cleaning system, according to claim 2, further comprising at least one housing adapted to house said at least one vacuum hose, on said at least one hose reel, below such at least one waterline of such at least one pool of water.

5. The cleaning system, according to claim 4, wherein said at least one housing further comprises at least one door adapted to provide at least one exit from said at least one housing into such at least one pool of water.

6. The cleaning system, according to claim 5, wherein said at least one door is below such at least one waterline of such at least one pool of water.

7. The cleaning system, according to claim 4, wherein said at least one vacuum hose is entirely within said at least one housing when said at least one vacuum hose is retracted for storage.

8. The cleaning system, according to claim 2, wherein said at least one vacuum hose further comprises at least one vacuum cleaner, wherein said at least one vacuum cleaner is attached to said at least one first end of said at least one vacuum hose.

9. The cleaning system, according to claim 2, wherein said at least one hose deployer comprises at least one automatic hose deployer adapted to automatically deploy said at least one vacuum hose when said at least one vacuum pump is turned on.

10. The cleaning system, according to claim 2, wherein said at least one hose deployer is powered by said at least one vacuum pump.

11. The cleaning system, according to claim 10, further comprising at least one automatic switch adapted to automatically switch said at least one vacuum pump from powering said at least one hose deployer to pulling water through said at least one vacuum hose after said at least one hose deployer deploys said at least one vacuum hose.

12. The cleaning system, according to claim 2, further comprising at least one hydraulic motor adapted to power at least one motor with water moved by said at least one vacuum pump.

13. The cleaning system, according to claim 12, wherein said at least one hose deployer is powered by said at least one hydraulic motor.

14. The cleaning system, according to claim 2, wherein said at least one hose retractor comprises at least one spring adapted to wind said at least one hose reel.

15. The cleaning system, according to claim 2, wherein said at least one hose deployer comprises at least one articulated carrier adapted to carry said at least one vacuum hose from at least one retracted position to at least one deployed position and vice versa.

16. The cleaning system, according to claim 15, further comprising at least one retraction detector adapted to detect the complete retraction of said at least one vacuum hose onto said at least one reel.

17. The cleaning system, according to claim 2, further comprising at least one deployment detector adapted to detect the finished deployment of said at least one vacuum hose off of said at least one reel.

18. The cleaning system, according to claim 17, wherein said at least one hose deployer is powered by said at least one vacuum pump prior to said at least one deployment detector detecting the finished deployment of said at least one vacuum hose off of said at lest one reel.

19. The cleaning system, according to claim 17, wherein said at least one vacuum pump pulls water through said at least one vacuum hose after said at least one deployment detector detects the finished deployment of said at least one vacuum hose off of said at least one reel.

20. The cleaning system, according to claim 17, further comprising at least one automatic switch adapted to automatically switch said at least one vacuum pump from powering said at least one hose deployer to pulling water through said at least one vacuum hose after said at least one deployment detector detects the finished deployment of said at least one vacuum hose off of said at least one reel.

21. The cleaning system, according to claim 20, wherein said at least one automatic switch comprises at least one hydraulic actuator.

22. The cleaning system, according to claim 17, wherein said at least one deployment detector comprises:

a) at least one spring-loaded lever adapted to provide at least one spring-loaded lever on the interior of said at least one hose reel i) wherein said at least one spring-loaded lever is compressed when said at least one vacuum hose presses said at least one spring-loaded lever; and ii) wherein said at least one spring-loaded lever is released when said at least one vacuum hose is removed from said at least one spring-loaded lever;

b) at least one spring-loaded bar adapted to provide at least one spring-loaded bar on the exterior of said at least one hose reel i) wherein said at least one spring-loaded bar is pulled into at least one retracted position when said at least one spring-loaded lever is compressed; and ii) wherein said at least one spring-loaded bar means is released into at least one extended position when said at least one spring-loaded lever is released;

c) at least one spring-loaded switch i) wherein said at least one spring-loaded switch is open when said at least one spring-loaded bar is pulled into such at least one retracted position; and ii) wherein said at least one spring-loaded switch is closed when said at least one spring-loaded bar is released into such at least one extended position and contacts said at least one spring-loaded switch.

23. The cleaning system, according to claim 2, wherein said at least one hose deployer comprises:

a) at least one hydraulic motor;

b) wherein said at least one hydraulic motor is powered by said at least one vacuum pump;

c) at least one hose-guiding wheel adapted to guide said at least one vacuum hose;

d) at least one hose-moving wheel adapted to move said at least one vacuum hose;

e) at least one wheel compressor adapted to compress said at least one vacuum hose between said at least one hose-guiding wheel and said at least one hose-moving wheel;

f) wherein said at least one wheel compressor is actuated by said at least one vacuum pump; and g) at least one drive adapted to drive said at least one hose-moving wheel off of said at least one hydraulic motor;

h) whereby, when said at least one vacuum pump is turned on, said at least one vacuum hose is laterally compressed and is rolled longitudinally between said at least one hose-guiding wheel and said at least one hose-moving wheel.

24. The cleaning system, according to claim 23, wherein said at least one drive comprises at least one drive chain.

25. The cleaning system, according to claim 24, further comprising at least one drive tensioner adapted to provide consistent tension to said at least one drive chain.

26. The cleaning system, according to claim 23, wherein said at least one hose-guiding wheel comprises said at least one hose-moving wheel.

27. A pool cleaning system, comprising:

a) at lest one vacuum hose;

b) at least one hose deployer adapted to deploy said at least one vacuum hose from at least one retracted position; and c) at least one hose retractor adapted to retract said at least one vacuum hose from at least one deployed position;

d) wherein said at least one hose deployer comprises at least one hydraulic actuator;

g) wherein said at least one hose retractor comprises at least one automatic hose retractor adapted to automatically retract said at least one vacuum hose when said at least one vacuum pump is turned off.

28. A cleaning system, relating to at least one automatic vacuum relating to cleaning at least one pool of water having at least one waterline, comprising:

a) at least one vacuum hose having at least one first end and at least one second end;

b) at least one vacuum pump, wherein said at least one vacuum pump is attached to said at least one second end of said at least one vacuum hose;

c) at least one hose reel adapted to reel said at least one vacuum hose;

d) at least one hose deployer adapted to deploy said at least one first end of said at least one vacuum hose into such at least one pool of water; and e) at least one hose retractor adapted to retract said at least one vacuum hose onto said at least one hose reel;

f) wherein said at least one vacuum hose is adapted to remain continuously full of water when retracted onto said at least one hose reel;

g) wherein said at least one hose deployer is powered by said at least one vacuum pump;

h) at least one automatic switch adapted to automatically switch said at least one vacuum pump from powering said at least one hose deployer to pulling water through said at least one vacuum hose after said at least one hose deployer deploys said at least one vacuum hose.

29. A cleaning system, relating to at least one automatic vacuum relating to cleaning at least one pool of water having at least one waterline, comprising:

a) at least one vacuum hose having at least one first end and at least one second end;

b) at least one vacuum pump, wherein said at least one vacuum pump is attached to said at least one second end of said at least one vacuum hose;

c) at least one hose reel adapted to reel said at least one vacuum hose;

d) at least one hose deployer adapted to deploy said at least one first end of said at least one vacuum hose into such at least one pool of water; and e) at least one hose retractor adapted to retract said at least one vacuum hose onto said at least one hose reel;

f) wherein said at least one vacuum hose is adapted to remain continuously full of water when retracted onto said at least one hose reel;

g) wherein said at least one hose deployer comprises at least one articulated carrier adapted to carry said at least one hose deployer from at least one retracted position to at least one deployed position and vice versa.

30. A cleaning system, relating to at least one automatic vacuum relating to cleaning at least one pool of water having at least one waterline, comprising:

a) at least one vacuum hose having at least one first end and at least one second end;

b) at least one vacuum pump, wherein said at least one vacuum pump is attached to said at least one second end of said at least one vacuum hose;

c) at least one hose reel adapted to reel said at least one vacuum hose;

d) at least one hose deployer adapted to deploy said at least one first end of said at least one vacuum hose into such at least one pool of water; and e) at least one hose retractor adapted to retract said at least one vacuum hose onto said at least one hose reel;

f) wherein said at least one vacuum hose is adapted to remain continuously full of water when retracted onto said at least one hose reel;

g) at least one deployment detector adapted to detect the finished deployment of said at least one vacuum hose off of said at least one reel.

31. A cleaning system, relating to at least one automatic vacuum relating to cleaning at least one pool of water having at least one waterline, comprising:

a) at least one vacuum hose having at least one first end and at least one second end;

b) at least one vacuum pump, wherein said at least one vacuum pump is attached to said at least one second end of said at least one vacuum hose;

c) at least one hose reel adapted to reel said at least one vacuum hose;

d) at least one hose deployer adapted to deploy said at least one first end of said at least one vacuum hose into such at least one pool of water; and e) at least one hose retractor adapted to retract said at least one vacuum hose onto said at least one hose reel;

f) wherein said at least one vacuum hose is adapted to remain continuously full of water when retracted onto said at least one hose reel;

g) wherein said at least one hose deployer comprises:

i. at least one hydraulic motor;

ii. wherein said at least one hydraulic motor is powered by said at least one vacuum pump;

iii. at least one hose-guiding wheel adapted to guide said at least one vacuum hose;

iv. at least one hose-moving wheel adapted to move said at least one vacuum hose;

v. at least one wheel compressor adapted to compress said at least one vacuum hose between said at least one hose-guiding wheel and said at least one hose-moving wheel;

vi. wherein said at least one wheel compressor is actuated by said at least one vacuum pump; and vii. at least one drive adapted to drive said at least one hose-moving wheel off of said at least one hydraulic motor;

viii. whereby, when said at least one vacuum pump is turned on, said at least one vacuum hose is laterally compressed and is rolled longitudinally between said at least one hose-guiding wheel and said at least one hose-moving wheel.

32. A pool cleaning system, comprising:

a) at lest one vacuum hose;

b) at least one hose deployer adapted to deploy said at least one vacuum hose from at least one retracted position; and c) at least one hose retractor adapted to retract said at least one vacuum hose from at least one deployed position;

d) wherein said at least one hose deployer comprises at least one hydraulic actuator;

e) at least one deployment detector adapted to detect the finished deployment of said at least one vacuum hose off of said at least one reel.

33. A pool cleaning system, comprising:

a) at lest one vacuum hose;

b) at least one hose deployer adapted to deploy said at least one vacuum hose from at least one retracted position; and c) at least one hose retractor adapted to retract said at least one vacuum hose from at least one deployed position;

d) wherein said at least one hose deployer comprises at least one hydraulic actuator;

e) at least one deployment detector adapted to detect the finished deployment of said at least one vacuum hose off of said at least one reel.

* * * * *